US007697695B2

(12) United States Patent
Sakagami

(10) Patent No.: US 7,697,695 B2
(45) Date of Patent: Apr. 13, 2010

(54) STEREOPHONIC SOUND REPRODUCING SYSTEM AND STEREOPHONIC SOUND REPRODUCING APPARATUS

(75) Inventor: Kei Sakagami, Tokorozawa (JP)

(73) Assignee: Pioneer Corporation, Meguro-ku, Tokyo (JP)

( * ) Notice: Subject to any disclaimer, the term of this patent is extended or adjusted under 35 U.S.C. 154(b) by 517 days.

(21) Appl. No.: 10/593,086

(22) PCT Filed: Mar. 8, 2005

(86) PCT No.: PCT/JP2005/003942

§ 371 (c)(1),
(2), (4) Date: Sep. 15, 2006

(87) PCT Pub. No.: WO2005/089018

PCT Pub. Date: Sep. 22, 2005

(65) Prior Publication Data

US 2007/0211904 A1 Sep. 13, 2007

(30) Foreign Application Priority Data

Mar. 16, 2004 (JP) ..... P2004-074540

(51) Int. Cl.
*H04R 5/00* (2006.01)
*H04R 5/02* (2006.01)

(52) U.S. Cl. ..... 381/17; 381/18; 381/19; 381/300; 381/310

(58) Field of Classification Search ..... 381/17–19, 381/300, 309–310, 304, 332, 335, 386; 181/145, 181/154

See application file for complete search history.

(56) References Cited

U.S. PATENT DOCUMENTS

| | | | | |
|---|---|---|---|---|
| 5,796,845 | A * | 8/1998 | Serikawa et al. | 381/18 |
| 6,862,356 | B1 * | 3/2005 | Makino | 381/1 |
| 6,975,738 | B2 * | 12/2005 | Yang et al. | 381/306 |
| 7,043,031 | B2 * | 5/2006 | Klayman et al. | 381/98 |
| 7,292,697 | B2 * | 11/2007 | Tatsuta et al. | 381/18 |
| 2004/0062402 | A1 * | 4/2004 | Fujita et al. | 381/18 |

FOREIGN PATENT DOCUMENTS

| | | |
|---|---|---|
| JP | 11-113098 | 4/1999 |
| JP | 2001-157294 | 6/2001 |
| JP | 2003-134598 | 5/2003 |

* cited by examiner

*Primary Examiner*—Vivian Chin
*Assistant Examiner*—George C Monikang
(74) *Attorney, Agent, or Firm*—Drinker Biddle & Reath LLP

(57) ABSTRACT

To provide a surround sound reproducing system capable of obtaining high realistic sensation even in the case where an integral surround speaker cannot be installed rearward of a listening position.

A surround system 100 is constructed by: a sound source output device 110 for outputting bit stream data of a predetermined format; a signal processor 120 for performing a signal process on every audio signal of each channel; and a speaker system 130 made of various speakers corresponding to various channels and including an integral surround speaker. The signal processor 120 has a signal processing unit 200 including: a switch control unit 203 for selecting one of right and left surround signals amplified from a surround speaker; a frequency correcting circuit 204 for correcting the frequency characteristic of the surround signal selected by the switch control unit 203; and an adder 205 for adding the surround signal whose frequency characteristic was corrected to a main signal.

13 Claims, 8 Drawing Sheets

STEREOPHONIC SOUND REPRODUCING SYSTEM AND STEREOPHONIC SOUND REPRODUCING APPARATUS

TECHNICAL FIELD

The present invention belongs to a technical field of a stereophonic sound reproducing apparatus for performing stereophonic reproduction with the realism of a live performance.

BACKGROUND ART

In recent years, a surround system is being practically used, in which each of a plurality of speakers such as a center speaker, right and left front speakers or right and left rear speakers (also called surround speakers) has the role of reproduction sounds, and addition of reverberant sound, change in the frequency characteristic, and the like is performed in each of the speakers, thereby amplifying sound such as voice and music.

A known representative surround system is a Dolby™ digital 5.1ch (channel) surround system constructed by a center speaker and front speakers installed on the right and left sides of the center speaker, which are provided forward of a listener, surround speakers installed on the right and left rear sides or right and left sides of the listener, and a sound woofer dedicated to amplify sound only in the lower audio frequencies of 120 Hz or less. There is also a known conventional method for use in such a 5.1ch surround system, in which right and left surround speakers are formed integrally and installed rearward of a listening position to amplify sound so that the surround speakers can be set easily.

DISCLOSURE OF INVENTION

Problems to be Solved by the Invention

In the conventional surround system, however, in some environments of a sound field space, a surround speaker obtained by integrating right and left surround speakers (hereinbelow, simply called integral surround speaker) cannot be installed on the rear side of the listening position. In this case, the integral surround speaker is installed on the right or left side of the listening position. For example, in the case where the integral surround speaker is installed on the right side, the surround speaker for the left side is also installed on the right side. Consequently, something wrong occurs in auditory lateralization, and a sound field space with high realistic sensation cannot be provided.

The present invention has been achieved in consideration of the problems. An object of the invention is to provide a surround sound reproducing system that creates a sound field space with high realistic sensation even in the case where an integral surround speaker cannot be installed on the rear side of a listening position in a surround system having the integral surround speaker.

Means for Solving the Problems

In order to solve the above problems, the invention of claim 1 relates to a stereophonic sound reproducing system comprising:

a stereophonic sound reproducing apparatus for providing a sound field space having the realism of a live performance to the listener by amplifying a plurality of input stereophonic sound signals by speakers corresponding to the stereophonic sound signals;

at least a pair of right and left main speakers installed forward of the listening position and amplifying main signals as stereophonic sound signals corresponding to the speakers; and an integral surround speaker obtained by integrally forming a left surround speaker for generating the stereophonic sound by amplifying a surround signal as a stereophonic sound signal of a left-side component with respect to the listening position as a reference, and a right surround speaker for generating the stereophonic sound by amplifying a surround signal as the stereophonic sound signal of a right-side component with respect to the listening position as a reference, wherein the stereophonic sound reproducing apparatus comprises:

signal adjusting means, in the case where the integral surround speaker is installed in a position that makes arrangement asymmetrical with respect to the listening position as a center, for adjusting the frequency characteristic of a surround signal of a component of the side different from the side on which the integral surround speaker is deviated and installed on the basis of a transfer function for creating a sound image in a predetermined listening position;

adding means for adding a component of at least part of the adjusted surround signal to a main signal of the component on the same side as that of the adjusted surround signal; and output means for outputting the resultant main signal to the corresponding main speaker and outputting at least part of the surround signal whose frequency characteristic is adjusted to the corresponding surround speaker.

The invention of claim 7 relates to a stereophonic sound reproducing system comprising:

a stereophonic sound reproducing apparatus for providing a sound field space having the realism of a live performance to the listener by amplifying a plurality of input stereophonic sound signals by speakers corresponding to the stereophonic sound signals;

at least a pair of right and left main speakers installed forward of the listening position and amplifying main signals as stereophonic sound signals corresponding to the speakers; and an integral surround speaker obtained by integrally forming a left surround speaker for generating the stereophonic sound by amplifying a surround signal as a stereophonic sound signal of a left-side component with respect to the listening position as a reference, and a right surround speaker for generating the stereophonic sound by amplifying a surround signal as the stereophonic sound signal of a right-side component with respect to the listening position as a reference, wherein the stereophonic sound reproducing apparatus comprises:

generating means, in the case where the integral surround speaker is installed in a position that makes arrangement asymmetrical with respect to the listening position as a center, for generating a differential signal by subtracting a surround signal of a component on the side on which integral surround speaker is deviated and installed from a surround signal of a component of the side different from the side on which the integral surround speaker is deviated and installed;

first computing means for performing computing process of adding the generated differential signal to the surround signal of the component on the side different from the side on which the integral surround speaker is deviated and installed;

second computing means for performing computing process of subtracting the generated differential signal from the surround signal of the component on the same side as the side on which the integral surround speaker is deviated and installed;

adding means for adding at least part of each of the surround signals subjected to the computing process to a main signal of a component on the same side; and output means for outputting the resultant main signal to the corresponding main speaker and outputting at least part of the surround signal subjected to the differential signal computing process to the corresponding surround speaker.

The invention of claim 8 relates to a stereophonic sound reproducing system comprising:

a stereophonic sound reproducing apparatus for providing a sound field space having the realism of a live performance to the listener by amplifying a plurality of input stereophonic sound signals by speakers corresponding to the stereophonic sound signals;

at least a pair of right and left main speakers installed forward of the listening position and amplifying main signals as stereophonic sound signals corresponding to the speakers; and an integral surround speaker obtained by integrally forming a left surround speaker for generating the stereophonic sound by amplifying a surround signal as a stereophonic sound signal of a left-side component with respect to the listening position as a reference, and a right surround speaker for generating the stereophonic sound by amplifying a surround signal as the stereophonic sound signal of a right-side component with respect to the listening position as a reference, wherein the stereophonic sound reproducing apparatus comprises:

generating means, in the case where the integral surround speaker is installed in a position that makes arrangement asymmetrical with respect to the listening position as a center, for generating a delay component having predetermined delay time with respect to a surround signal of a component on the side different from the side on which integral surround speaker is deviated and installed;

computing means for performing computing process of adding the generated delay component to the surround signal used at the time of generating the delay component;

adding means for adding a component of at least part of the surround signal subjected to the computing process to a main signal of a component on the same side as that of the surround signal subjected to the computing process; and output means for outputting the resultant main signal to the corresponding main speaker and outputting at least part of the surround signal to which the delay component is added to the corresponding surround speaker.

The invention of claim 9 relates to a stereophonic sound reproducing system comprising:

a stereophonic sound reproducing apparatus for providing a sound field space having the realism of a live performance to the listener by amplifying a plurality of input stereophonic sound signals by speakers corresponding to the stereophonic sound signals;

at least a pair of right and left main speakers installed forward of the listening position and amplifying main signals as stereophonic sound signals corresponding to the speakers; and an integral surround speaker obtained by integrally forming a left surround speaker for generating the stereophonic sound by amplifying a surround signal as a stereophonic sound signal of a left-side component with respect to the listening position as a reference, and a right surround speaker for generating the stereophonic sound by amplifying a surround signal as the stereophonic sound signal of a right-side component with respect to the listening position as a reference, wherein the stereophonic sound reproducing apparatus comprises:

generating means, in the case where the integral surround speaker is installed in a position that makes arrangement asymmetrical with respect to the listening position as a center, for generating a differential signal by subtracting a surround signal of a component on the side on which integral surround speaker is deviated and installed from a surround signal of a component of the side different from the side on which the integral surround speaker is deviated and installed;

generating means for generating a delay component having predetermined delay time with respect to the generated differential signal;

first computing means for performing computing process of adding the generated delay component to the surround signal of the component on the side different from the side on which the integral surround speaker is deviated and installed;

second computing means for performing computing process of subtracting the generated delay component from the surround signal of the component on the same side as the side on which the integral surround speaker is deviated and installed;

adding means for adding at least part of each of the surround signals subjected to the computing process to a main signal of a component on the same side; and output means for outputting the resultant main signal to the corresponding main speaker and outputting at least part of the surround signal subjected to the delay component computing process to the corresponding surround speaker.

The invention of claim 10 relates to a stereophonic sound reproducing apparatus for providing a sound field space having the realism of a live performance to the listener by amplifying a plurality of input stereophonic sound signals by speakers corresponding to the stereophonic sound signals, in the case of amplifying sound by at least a pair of right and left main speakers installed forward of the listening position and amplifying main signals as stereophonic sound signals corresponding to the speakers, and an integral surround speaker obtained by integrally forming a left surround speaker for generating the stereophonic sound by amplifying a surround signal as a stereophonic sound signal of a left-side component with respect to the listening position as a reference, and a right surround speaker for generating the stereophonic sound by amplifying a surround signal as the stereophonic sound signal of a right-side component with respect to the listening position as a reference, and installing the integral surround speaker in a position that makes arrangement asymmetrical with respect to the listening position as a center, the apparatus comprising:

signal adjusting means for adjusting the frequency characteristic of a surround signal of a component of the side different from the side on which the integral surround speaker is deviated and installed on the basis of a transfer function for creating a sound image in a predetermined listening position;

adding means for adding a component of at least part of the adjusted surround signal to a main signal of the component on the same side as that of the adjusted surround signal; and output means for outputting the resultant main signal to the corresponding main speaker and outputting at least part of the surround signal whose frequency characteristic is adjusted to the corresponding surround speaker.

The invention of claim 11 relates to a stereophonic sound reproducing apparatus for providing a sound field space having the realism of a live performance to the listener by amplifying a plurality of input stereophonic sound signals by speakers corresponding to the stereophonic sound signals, in the case of amplifying sound by at least a pair of right and left main speakers installed forward of the listening position and amplifying main signals as stereophonic sound signals corresponding to the speakers, and an integral surround speaker obtained by integrally forming a left surround speaker for generating the stereophonic sound by amplifying a surround signal as a stereophonic sound signal of a left-side component with respect to the listening position as a reference, and a right surround speaker for generating the stereophonic sound by amplifying a surround signal as the stereophonic sound signal of a right-side component with respect to the listening position as a reference, and installing the integral surround speaker in a position that makes arrangement asymmetrical with respect to the listening position as a center, the apparatus comprising:

generating means for generating a differential signal by subtracting a surround signal of a component on the side on which integral surround speaker is deviated and installed from a surround signal of a component of the side different from the side on which the integral surround speaker is deviated and installed;

first computing means for performing computing process of adding the generated differential signal to the surround signal of the component on the side different from the side on which the integral surround speaker is deviated and installed;

second computing means for performing computing process of subtracting the generated differential signal from the surround signal of the component on the same side as the side on which the integral surround speaker is deviated and installed;

adding means for adding at least part of each of the surround signals subjected to the computing process to a main signal of a component on the same side; and output means for outputting the resultant main signal to the corresponding main speaker and outputting at least part of the surround signal subjected to the differential signal computing process to the corresponding surround speaker.

The invention of claim 12 relates to a stereophonic sound reproducing apparatus for providing a sound field space having the realism of a live performance to the listener by amplifying a plurality of input stereophonic sound signals by speakers corresponding to the stereophonic sound signals, in the case of amplifying sound by at least a pair of right and left main speakers installed forward of the listening position and amplifying main signals as stereophonic sound signals corresponding to the speakers, and an integral surround speaker obtained by integrally forming a left surround speaker for generating the stereophonic sound by amplifying a surround signal as a stereophonic sound signal of a left-side component with respect to the listening position as a reference, and a right surround speaker for generating the stereophonic sound by amplifying a surround signal as the stereophonic sound signal of a right-side component with respect to the listening position as a reference, and installing the integral surround speaker in a position that makes arrangement asymmetrical with respect to the listening position as a center, the apparatus comprising:

generating means for generating a delay component having predetermined delay time with respect to a surround signal of a component on the side different from the side on which integral surround speaker is deviated and installed;

computing means for performing computing process of adding the generated delay component to the surround signal used at the time of generating the delay component;

adding means for adding a component of at least part of the surround signal subjected to the computing process to a main signal of a component on the same side as that of the surround signal subjected to the computing process; and output means for outputting the resultant main signal to the corresponding main speaker and outputting at least part of the surround signal to which the delay component is added to the corresponding surround speaker.

The invention of claim 13 relates to a stereophonic sound reproducing apparatus for providing a sound field space having the realism of a live performance to the listener by amplifying a plurality of input stereophonic sound signals by speakers corresponding to the stereophonic sound signals, in the case of amplifying sound by at least a pair of right and left main speakers installed forward of the listening position and amplifying main signals as stereophonic sound signals corresponding to the speakers, and an integral surround speaker obtained by integrally forming a left surround speaker for generating the stereophonic sound by amplifying a surround signal as a stereophonic sound signal of a left-side component with respect to the listening position as a reference, and a right surround speaker for generating the stereophonic sound by amplifying a surround signal as the stereophonic sound signal of a right-side component with respect to the listening position as a reference, and installing the integral surround speaker in a position that makes arrangement asymmetrical with respect to the listening position as a center, the apparatus comprising:

generating means for generating a differential signal by subtracting a surround signal of a component on the side on which integral surround speaker is deviated and installed from a surround signal of a component of the side different from the side on which the integral surround speaker is deviated and installed;

generating means for generating a delay component having predetermined delay time with respect to the generated differential signal;

first computing means for performing computing process of adding the generated delay component to the surround signal of the component on the side different from the side on which the integral surround speaker is deviated and installed;

second computing means for performing computing process of subtracting the generated delay component from the surround signal of the component on the same side as the side on which the integral surround speaker is deviated and installed;

adding means for adding at least part of each of the surround signals subjected to the computing process to a main signal of a component on the same side; and output means for outputting the resultant main signal to the corresponding main speaker and outputting at least part of the surround signal subjected to the delay component computing process to the corresponding surround speaker.

DESCRIPTION OF REFERENCE NUMERALS

Figure 1:
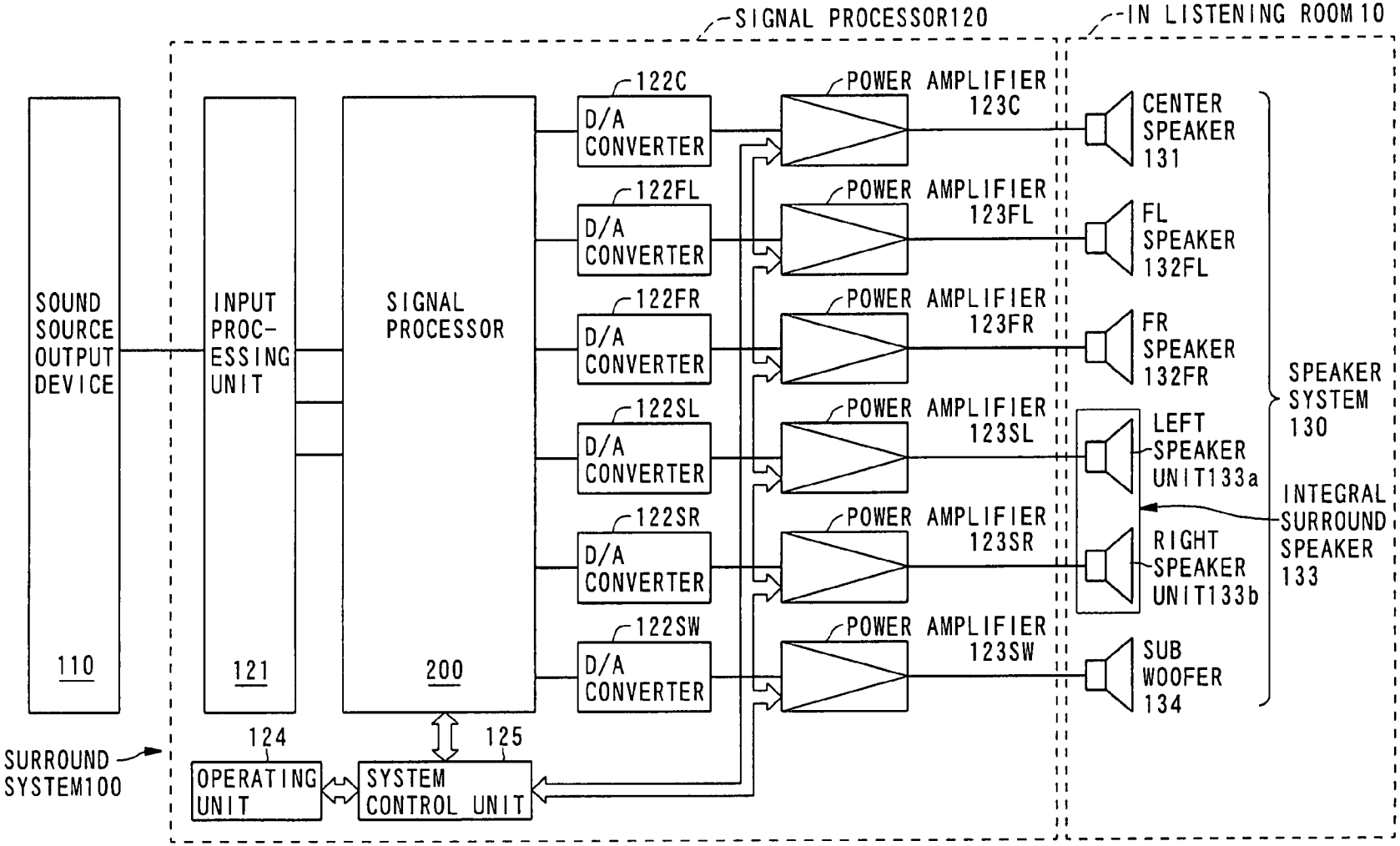
FIG. 1 is a block diagram showing the configuration in a surround system of a first embodiment of the invention.

100: surround system
110: sound source output device
120: signal processor
125: system control unit
130: speaker system
132FL: FL (front left) speaker
132FR: FR (front right) speaker
133: integral surround speaker
200: signal processing unit
203: switch control unit
204: frequency correcting circuit
205: adder
300: stereo wide processing unit
400: reverberant sound adding circuit
500: reverberant sound adding stereo wide processor

BEST MODE FOR CARRYING OUT THE INVENTION

Preferred embodiments of the invention will now be described with reference to the drawings.

The embodiments described below relate to the case of applying a stereophonic sound reproducing apparatus or a stereophonic sound reproducing system of the invention to a 5.1ch surround system (hereinbelow, simply called surround system).

First Embodiment

First, a first embodiment of a surround system according to the invention will be described with reference to FIGS. 1 to 5.

Figure 2:
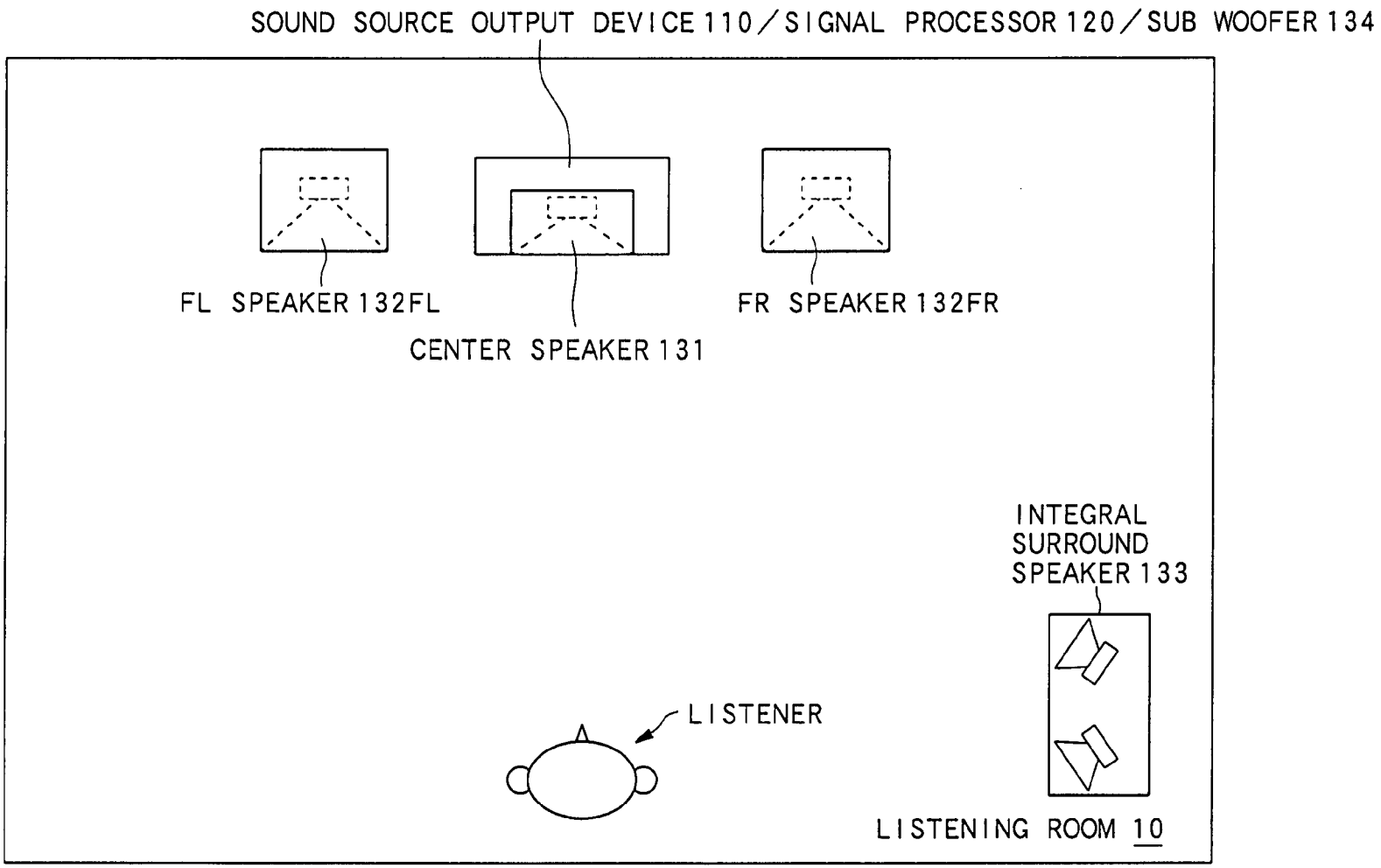
FIG. 2 shows an example for explaining installation of speakers in the surround system of the first embodiment.

The configuration of the surround system of the embodiment will now be described with reference to FIGS. 1 and 2. FIG. 1 is a block diagram showing the configuration of the surround system of the embodiment. FIG. 2 shows an example for explaining installation of speakers in the surround system of the embodiment.

As shown in FIG. 1, a surround system 100 of the first embodiment is installed in a listening room 10, that is, a sound field space for providing the listener with reproduction sound. The surround system 100 reproduces or obtains a sound source and performs a predetermined signal process on the reproduced sound or obtained sound. The surround system 100 amplifies the signal-processed sound every speaker and on the speaker unit basis by a speaker system 130 made of a plurality of speakers including an integral surround speaker 133 in which surround speaker units for the right and left sides are integrally formed, thereby providing the listener with a sound field space with the realism of a live performance (with surrounding sound).

The surround system 100 is constructed by: a sound source output device 110 for outputting bit stream data of a predetermined format having a channel component corresponding to each speaker by reproducing a sound source such as a recording medium or obtaining a sound source from the outside such as a television signal; a signal processor 120 for decoding the bit stream output from the sound source output device 110 to an audio signal for each channel and performing a signal process on the audio signal of each channel; and the speaker system 130 made of various speakers corresponding to various channels.

The channels denote transmission paths of the audio signals output from the sound source output device 110, and each channel transmits an audio signal basically different from audio signals of the other channels.

The sound source output device 110 is constructed by, for example, a device for reproducing media such as CD (Compact Disc) or DVD (Digital Versatile Disc) or a receiver or receiving a digital television broadcast. The sound source output device 110 reproduces a sound source such as CD, thereby obtaining a broadcasted sound source and outputs bit stream data having a channel component corresponding to 5.1ch to the signal processor 120.

For example, the sound source output device 110 of the embodiment outputs bit stream data via an optical digital interface conforming to the SPDIF standard (CP-1201 standard developed by Japan Electronics and Information Technology Industries Association (JEITA)/the 60958 standard developed by The International Electrotechnical Commission (IEC)).

To the signal processor 120, the bit stream data having various channel components output from the sound source output device 110 is input. The signal processor 120 decodes the input bit stream data to audio signals of the respective channels.

The signal processor 120 performs:

(1) addition of delay time to each of the decoded audio signals;
(2) addition of the reverberant sound component to each of the decoded audio signals;
(3) adjustment of frequency components in the decoded audio signals; and
(4) addition to the audio signal of another channel in the audio signal components of the decoded channels.

By converting the signal-processed audio signals to analog signals, the signal level is adjusted. The signal processor 120 outputs each audio signal whose signal level is adjusted to each of the speakers of the speaker system 130.

The details of the configuration and operation of the signal processor 120 in the embodiment will be described later. For example, the signal processor 120 of the embodiment corresponds to a stereophonic sound reproducing apparatus of the invention.

The speaker system 130 has: a center speaker 131 installed forward of a listening position; a front right speaker (hereinbelow, called FR speaker) 132FR and a front left speaker (hereinbelow, called FL speaker) 132FL installed forward of the listening position and on the right and left sides of the center speaker 131; an integral surround speaker 133 in which a speaker unit 133*a* for amplifying a left-side component of a surround signal and a speaker unit 133*b* for amplifying a right-side component of a surround signal are integrally formed; and a speaker for lower audio frequencies (hereinbelow, called sub woofer) 134 installed in an arbitrary position, which are installed as shown in FIG. 2.

For example, the FL speaker 132FL and the FR speaker 132FR of the embodiment correspond to a main speaker of the invention. The integral surround speaker 133 corresponds to an integral surround speaker of the invention.

Concretely, the center speaker 131 is a full-range speaker having the reproducible frequency characteristic in almost the full range of the frequency band used at the time of amplifying an audio signal. The center speaker 131 amplifies the audio signal with its radial axis directed to the listener.

The center speaker 131 is desirably installed so that its radial axis is oriented to the listening point of the listener. However, it is sufficient that the center speaker 131 is installed in any listening point in the directivity angles of the center speaker 131.

The FL speaker 132FL and the FR speaker 132FR are, like the center speaker 131, full-range speakers having the reproducible frequency characteristic in an almost full range of the frequency band used at the time of amplifying an audio signal, and amplify the signals with their radial axes directed to the listener.

The FL speaker 132FL and the FR speaker 132FR are desirably installed so that their radial axes tilt with a predetermined angle, for example, 30 degrees with respect to an axis connecting the radial axis of the center speaker 131 and the listening position of the listener. It is however sufficient to install the FL speaker 132FL and the FR speaker 132FR in any listening points in the directivity angles of the FL speaker 132FL and the FR speaker 132FR.

The integral surround speaker 133 is obtained by integrating the speaker unit (hereinbelow, called left speaker unit) 133*a* for amplifying a left-side component and the speaker unit (hereinbelow, called right speaker unit) 133*b* for amplifying a right-side component in the full-range surround signal having the reproducible frequency characteristic in an almost full range of the frequency band used at the time of amplifying an audio signal like the center speaker 131.

Usually, in consideration of its nature, the integrally surround speaker 133 is usually installed rearward of the listening position, to be accurate, on a line connecting the center speaker 131 and the listening position. The embodiment relates to the stereophonic sound system applied in the case where the integral surround speaker 133 cannot be installed rearward of the listening position such as a case where there is no space rearward of the listening position. In the embodiment, therefore, the case where the integral surround speaker 133 is installed in a position so that the arrangement becomes asymmetrical with respect to the listening position as a center as shown in FIG. 2 will be described.

The sub woofer is constructed by a speaker having the frequency characteristic for reproducing only deep bass sound, for example, frequencies from hundreds Hz to a few kHz and having non-directivity as the directivity characteristic in principle. Although the sub woofer is installed near the center speaker 131 in FIG. 2, since the sub woofer has the characteristic of non-directivity, it can be installed in an arbitrary position.

The configuration and operation of the signal processor 120 of the embodiment will now be described.

The signal processor 120 of the embodiment has, as shown in FIG. 1: an input processing unit 121 to which bit stream data in a predetermined format having channel components is supplied and which converts the bit stream data to audio data in a signal format used at the time of decoding the data to audio signals in respective channels; and a signal processing unit 200 for decoding audio data obtained by the conversion to audio signals for respective channels and performing a signal process on the channel unit basis, particularly, a specific process on an audio signal corresponding to the integral surround speaker 133.

The signal processor 120 has: D/A converters 122 for performing digital/analog (hereinbelow, called D/A) conversion on the audio signals of the respective channels; power amplifiers 123 for amplifying the signal level of signals of the respective channels; an operating unit 124 for operating the components; and a system control unit 125 for controlling the components on the basis of the operation of the operating unit 124.

To the input processing unit 121, the bit stream data in a predetermined format having channel components is input. The input processing unit 121 converts the input bit stream data to audio data in a predetermined format, and outputs the converted audio data to the signal processing unit 200.

For example, the input processing unit 121 converts the input bit stream data to audio data of a three-wire system audio serial interface. Concretely, the input processing unit 121 converts the bit stream data to a bit clock signal, an LR clock signal, and compressed sound data, and outputs the resultant data to the signal processing unit 200.

To the signal processing unit 200, the audio data output from the input processing unit 121 is input. The signal processing unit 200 decodes the input audio data to audio signals of respective channels, performs a predetermined signal process on the channel unit basis, and outputs the audio signal of each channel to the corresponding D/A converter 122.

The details of the configuration and operation of the signal processing unit 200 in the embodiment will be described later.

To the D/A converters 122, the audio signals subjected to the signal processes are input on the channel unit basis. The D/A converters 122 convert the audio signals as the input digital signals to analog signals and output the analog signals to the respective power amplifiers 123.

To the power amplifiers 123, the processed audio signals are input on the channel unit basis. Under control of the system system control unit 125, each of the power amplifiers 123 amplifies the signal level of the audio signal of a corresponding channel on the basis of an instruction of volume designated by the operating unit 124, and outputs the amplified audio signal to the speaker corresponding to the channel.

The operating unit 124 is constructed by a remote controller including a number of keys such as various confirmation buttons, selection buttons, and numeral keys or various key buttons. In particularly, in the embodiment, the operating unit 124 is used to input the position of installing the integral surround speaker 133.

The system control unit 125 controls, in a centralized manner, the general functions for performing stereophonic sound reproduction by amplifying the audio signals from the speakers. In particularly, in the case where the integral surround speaker 133 is installed in a position so that the arrangement becomes asymmetrical with respect to the position of the listener as a center, the system control unit 125 controls the signal processing unit 200 to perform a predetermined signal process on an audio signal of a component of a side different from the side on which the integral surround speaker 133 is installed.

Figure 3:
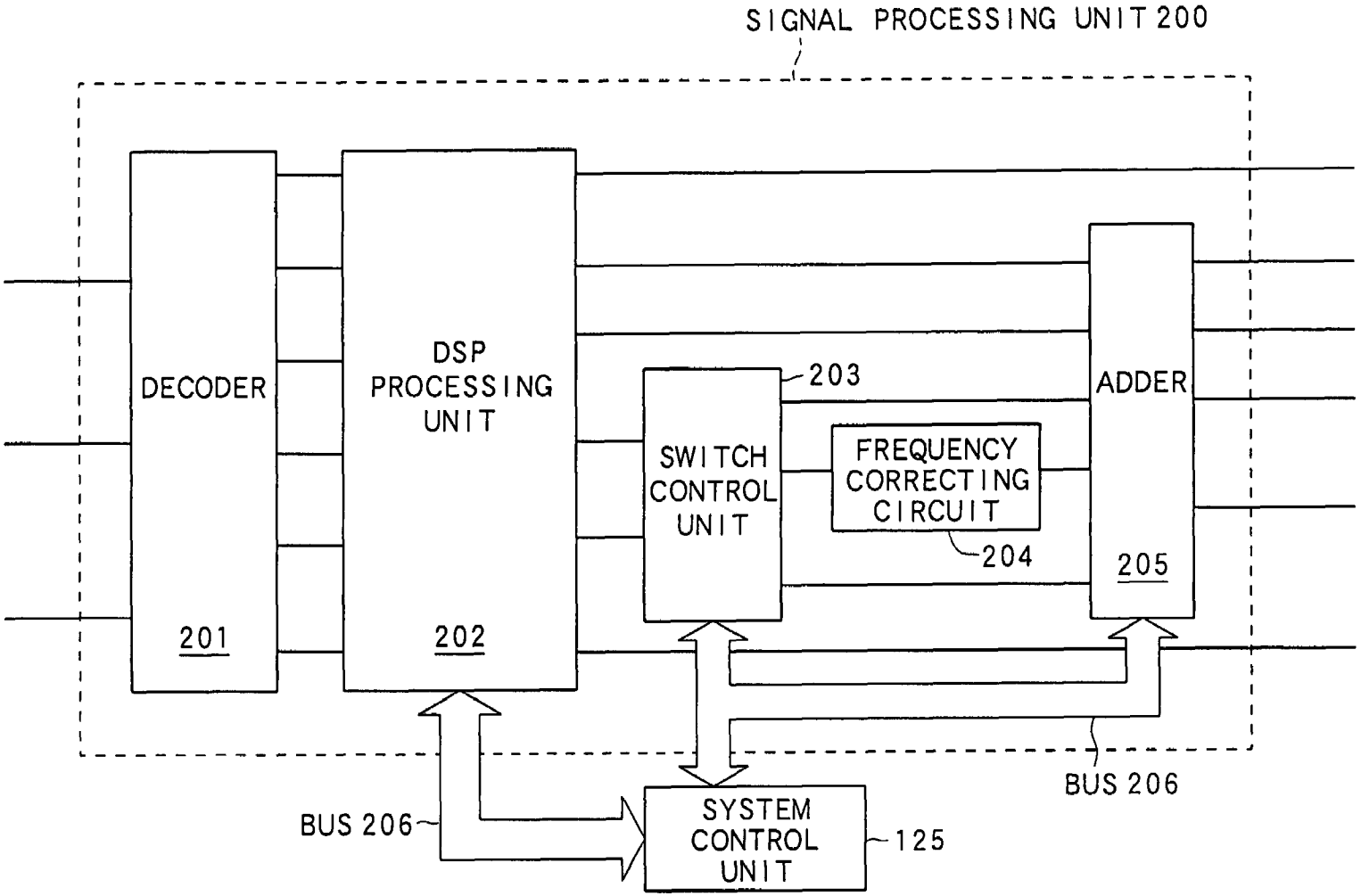
FIG. 3 is a block diagram showing the configuration of a signal processor in the first embodiment.
Figure 4:
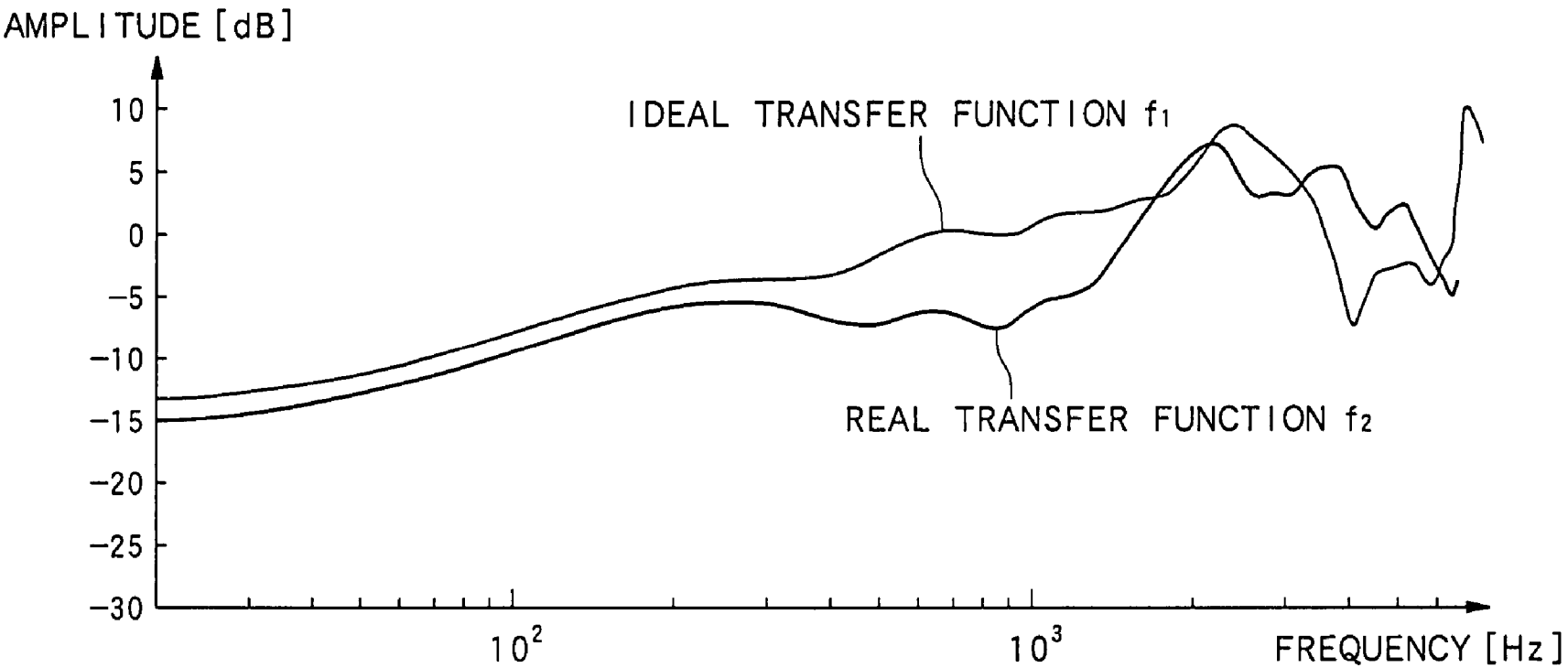
FIG. 4 shows an example of a graph of the head-related transfer function used at the time of correcting frequency characteristic in a frequency correcting circuit of the first embodiment.
Figure 5:
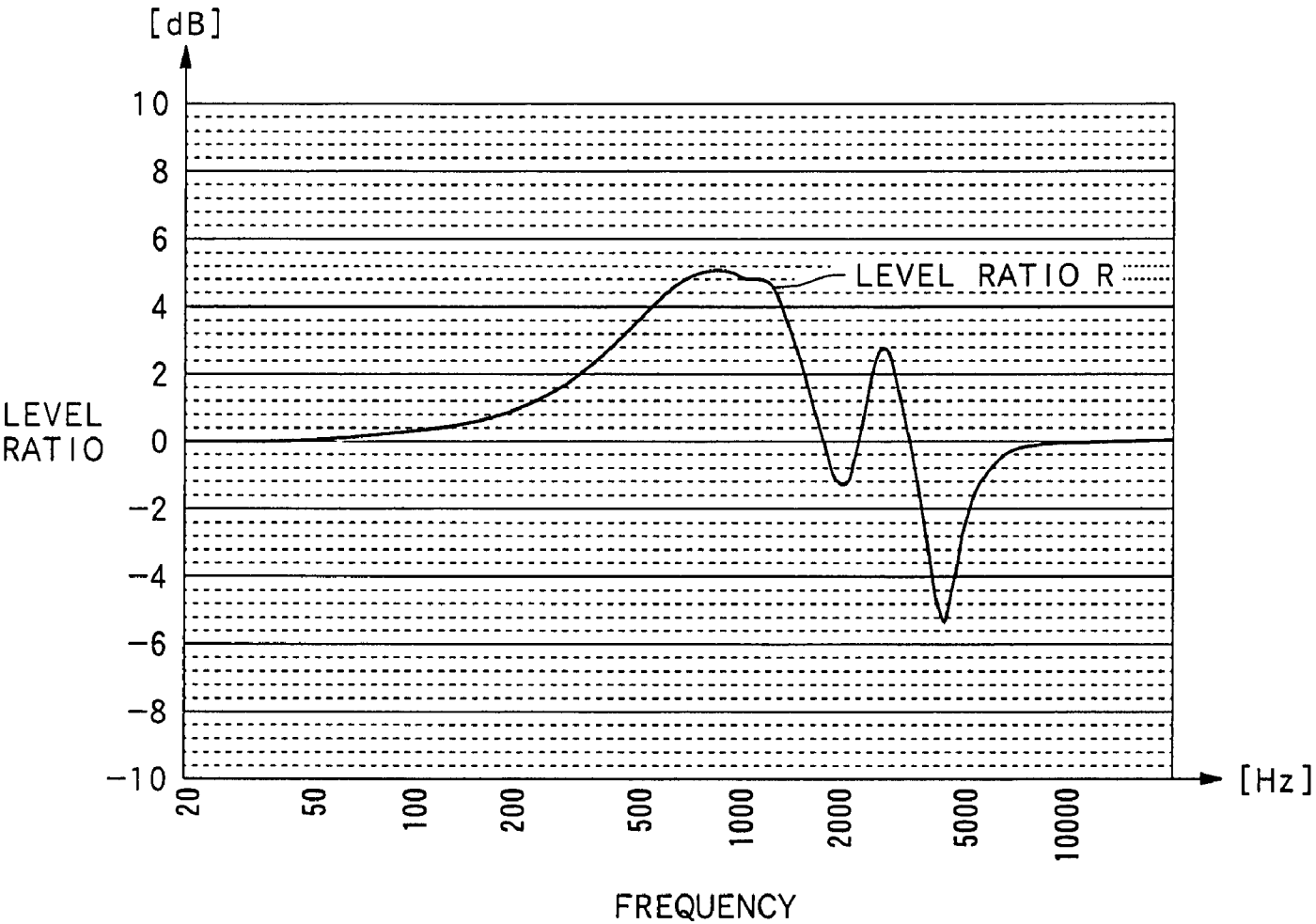
FIG. 5 shows an example of a graph of a level ratio used at the time of correcting frequency characteristic in the frequency correcting circuit of the first embodiment.

The configuration and operation of the signal processor of the embodiment will now be described with reference to FIGS. 3 to 5. FIG. 3 is a block diagram showing the configuration of the signal processor of the embodiment. FIG. 4 shows an example of the graph of a head-related transfer function used at the time of correcting the frequency characteristic in a frequency correcting circuit in the embodiment. FIG. 5 shows an example of the graph of the level ratio used at the time of correcting the frequency characteristic in a frequency correcting circuit 204 of the embodiment.

The signal processing unit 200 has: a decoder 201 for decoding input audio data to audio signals of respective channels; a DSP processing unit 202 for performing a predetermined digital signal process by operation of the operating unit 124 of the user; a switch control unit 203 for selecting a surround signal of one of right and left audio signals (hereinbelow, called surround signals) amplified from the surround speaker; a frequency correcting circuit 204 for correcting the frequency characteristic of the surround signal selected by the switch control unit 203; and an adder 205 for adding the surround signal whose frequency characteristic was corrected to an audio signal subjected to the DSP process and amplified from the main speaker (hereinbelow, called main signal).

The DSP processing unit 202, switch control unit 203, and adder 205 are connected to the system control unit 125 via a bus 206. Those components perform respective operations under control of the system control unit 125. For example, the frequency correcting circuit 204 of the embodiment corresponds to signal adjusting means of the invention, and the adder 205 corresponds to adding means and output means of the invention.

To the decoder 201, the input audio data, for example, the bit clock signal, the LR clock signal, and compression sound data are input. The decoder 201 decodes the input audio data to audio signals of respective channels, and outputs the audio signals to the DSP processing unit 202 on the channel unit basis.

To the DSP processing unit 202, the audio signals decoded on the channel unit basis are input. Under control of the system control unit 125, the DSP processing unit 202 performs predetermined digital signal process on the basis of an instruction input from the operating unit 124, and outputs the processed audio signals of the respective channels to the switch control unit 203, the adder 205, and the D/A converter.

For example, when a sound field such as church, stadium, or a specific hall is set (hereinbelow, simply called sound field setting) by the operating unit 124, the DSP processing unit 202 performs digital signal processes such as delay process, frequency characteristic correcting process, and process of addition to an audio signal of another channel in an arbitrary audio signal so that input audio data is amplified in the sound field.

In the second embodiment, to perform processes which will be described later on a surround signal amplified from the integral surround speaker 133 and a main signal amplified from the FL speaker 132FL or the FR speaker 132FR, the DSP processing unit 202 outputs the surround signal to the switch control unit 203 and outputs the main signal to the adder 205.

It is unnecessary to perform the signal process based on the setting position of the integral surround speaker 133 on the audio signal amplified from the center speaker 131 (hereinbelow, called center signal) and the audio signal amplified from the subwoofer (hereinbelow, called woofer signal). Consequently, the DSP processing unit 202 directly outputs the center signal and the woofer signal to the D/A converter 122.

To the switch control unit 203, a left surround signal to be amplified by the left speaker unit and a right surround signal to be amplified by the right speaker unit are input. Under control of the system control unit 125, the switch control unit 203 outputs one of the input right and left surround signals to the frequency correcting circuit 204, and outputs the surround signal which is not output to the frequency correcting circuit 204 to the adder 205.

Concretely, in the case where the integral surround speaker 133 is installed on the right or left side of the listening position, that is, in the case where the integral speaker is installed in a position so that arrangement becomes asymmetrical with respect to the listening position as a center and the instruction of such installation is given to the switch control unit 203 via the system control unit 125, the switch control unit 203 outputs the surround signal to be amplified on the side different from the side on which the integral surround speaker 133 is installed to the frequency correcting circuit 204. In this case, the switch control unit 203 outputs the surround signal to be amplified on the side the integral surround speaker 133 is installed directly to the adder 205.

For example, in the case where the integral surround speaker 133 is installed on the right side of the listening position as shown in FIG. 2, the switch control unit 203 outputs the left surround signal to the frequency correcting circuit 204 and outputs the right surround signal to the adder 205.

In the case where the integral surround speaker 133 is installed rearward of the listening position, that is, in the case where the surround speaker 133 is set symmetrically with respect to the listening position and the message indicative of the symmetrical state is sent by the operating unit 124, the system control unit 125 does not output an instruction for executing the switch control to the switch control unit 203. The switch control unit 203 therefore outputs the input surround signals directly to the adder 205.

To the frequency correcting circuit 204, one of the surround signals is input. The frequency correcting circuit 204 adjusts the input surround signal on the basis of data of the level ratio in frequency transfer functions (hereinbelow, called level ratio data) which are pre-stored internally and outputs the adjusted surround signal to the adder 205.

Concretely, level ratio data indicative of the ratio, which is calculated in advance, between an ideal head-related transfer function (hereinbelow, called ideal transfer function) of the case where the surround speaker is installed in a fixed position and ahead-related transfer function (hereinbelow, called actual transfer function) of the case where either the right or left surround speaker is installed on the side different from the fixed position is pre-stored in the frequency correcting circuit 204. When there is an input surround signal, the frequency correcting circuit 204 multiplies the input surround signal with the level ratio, and outputs the resultant surround signal to the adder 205.

For example, in the case where the integral surround speaker 133 is installed on the right side of the listening position as shown in FIG. 2, the frequency correcting circuit 204 calculates the level ratio at each frequency as shown in FIG. 5 from an ideal transfer function f1 and an actual transfer function f2 which are calculated in advance as shown in FIG. 5, and multiplies the input surround signal with the calculated level ratio R at each frequency.

The surround signal subjected to such a computing process has a property such that, in the case where the integral surround speaker 133 is installed on the right side of the listening position and the surround signal is amplified, the surround signal is recognized as if it is amplified by the integral surround speaker 133 installed on the rear side of the listening position.

The head-related transfer function (HRTF) denotes a transfer function indicative of a transfer characteristic of sound from a sound source to the ear drum of the listener in a space where there is no reflection wave, and is a function including physical information used by a human for perceiving a sound image.

To the adder 205, main signals, the surround signals output from the switch control unit 203, and the surround signal subjected to frequency adjustment are supplied. Under control of the system control unit 125, the adder 205 performs the process of adding the main signal and the surround signal and the surround signal outputting process, and outputs the main signals and the surround signals to the respective D/A converters.

To be concrete, in the case where the integral surround speaker 133 is installed on the right or left side of the listening position, that is, in the case where the integral speaker is installed asymmetrically with respect to the listening position as a center and the message indicative of the asymmetrical state is sent to the adder 205 via the system control unit 125, the adder 205 adds a predetermined component in the surround signal whose frequency characteristic was corrected to a main signal amplified from the main speaker on the same side with respect to the listening position, outputs the resultant to the D/A converter corresponding to the main signal, lowers the level of the surround signal whose frequency characteristic was corrected, and outputs the resultant signal to the D/A converter corresponding to the surround signal.

For example, in the case where the integral surround speaker 133 is installed on the right side of the listening position as shown in FIG. 2, the frequency characteristic correction is made on the left surround signal. Consequently, the adder 205 multiplies a left surround signal with a predetermined coefficient, adds the resultant signal to a left main signal, outputs the resultant left main signal and also outputs, as a left surround signal, a signal obtained by subtracting the left surround signal multiplied with the predetermined coefficient from the left surround signal. In other words, the adder 205 adds part of the surround signal whose frequency characteristic is corrected to a main signal and outputs, as the surround signal, the rest of the surround signal to the D/A converter.

In the embodiment, in the case where the integral surround speaker 133 is installed on the right or left side of the listening position, the adder 205 adds a signal obtained by multiplying a surround signal whose frequency characteristic was corrected with a coefficient (0.7) to a main signal and outputs, as a surround signal, a signal obtained by multiplying the surround signal whose frequency characteristic was corrected with a coefficient (0.3).

To perform the digital signal process, at the time of adding a surround signal whose frequency characteristic is corrected to a main signal, the adder 205 has to normalize each of main signals and surround signals. Specifically, a sum of a main signal and a surround signal does not exceed 1.0. By using the sum as a reference, the level of each of the main and surround signals is adjusted. At the time of output to the D/A converters, the adder 205 compensates the signal level by expanding the normalized level of each of the main and surround signals to the original level. In the embodiment, as for adjustment of the level of each signal, the compensation may be made not necessarily by the adder 205 but may be made by each of the power amplifiers 123 via the system control unit 125.

On the other hand, in the case where the integral surround speaker 133 is installed on the rear side of the listening position and a message indicative of the installation is sent by the operating unit 124, the system control unit 125 does not output an instruction for executing the switch control to the adder 205. The adder 205 outputs each of the input surround and main signals directly to a corresponding D/A converter.

As described above, the surround system 100 of the embodiment has: the signal processor 120 for allowing speakers to amplify a plurality of corresponding sound signals supplied on the basis of the sound signals, and providing a sound field space having the realism of a live performance to the listener; and the integral surround speaker 133 obtained by integrating the pair of right and left main speakers installed forward of the listening position and amplifying main signals as sound signals corresponding to the speakers, the left surround speaker for generating stereophonic sound by amplifying a surround signal as a sound signal of a left-side component with respect to the listening position as a reference, and a right surround speaker for generating stereophonic sound by amplifying a surround signal as a sound signal of a right-side component with respect to the listening position as a reference. The signal processor 120 has: the frequency correcting circuit 204, in the case where the integral sound speaker 133 is installed in a position that the arrangement becomes asymmetrical with respect to the listening position as a center, for adjusting the frequency characteristic of a surround signal of a component of the side different from the side on which the integral surround speaker 133 is installed on the basis of a transfer function for generating a sound image in the listening position; and the adder 205 for adding a component of at least part of the adjusted surround signal to a main signal of the same side component as that of the adjusted surround signal, outputting the resultant main signal to a corresponding main speaker, and outputting at least part of the surround signal whose frequency characteristic is adjusted to the corresponding surround speaker.

With the configuration, in the case where the integral surround speaker 133 is installed in a position that the arrangement becomes asymmetrical with respect to the listening position as a center, the surround system 100 of the embodiment adjusts the frequency characteristic of a surround signal of a component of a side different from the side on which the integral surround speaker 133 is installed on the basis of the predetermined transfer function for creating a sound image in the listening position. The surround system 100 adds a component of at least part of the adjusted surround signal to a main signal of a component on the same side as that of the adjusted surround signal, outputs the resultant main signal to a corresponding main speaker, and outputs at least a part of the surround signal whose frequency characteristic is adjusted to the surround speaker.

Therefore, when audio signals are amplified from the speakers, the listener can listen, in the listening position, the amplified sound of the left surround component from the left side. Even in the case where the integral surround speaker cannot be installed on the rear side of the listening position, a sound effect similar to that in the case where the integral surround speaker 133 is set on the rear side of the listening position can be obtained. As a result, even in the case where the integral sound speaker 133 is installed in a position different from a normal position, a sound field space with high realistic sensation can be provided for the user.

The surround system 100 of the embodiment has a configuration that the frequency correcting circuit 204 adjusts the frequency characteristic of each of the surround signals of the right-side and left-side components by using a transfer function.

With the configuration, the surround system 100 of the embodiment can adjust the frequency characteristic of each of the surround signals of the right-side and left-side components. Consequently, the frequency characteristic can be adjusted more specifically, and a sound field space with higher realistic sensation can be created.

The surround system 100 of the embodiment has the configuration that the frequency correcting circuit 204 adjusts the frequency characteristic of a surround signal by using the head-related transfer function (HRTF) as a transfer function for creating a sound image in a listening position in a predetermined space.

With the configuration, the surround system 100 of the embodiment can adjust the frequency characteristic by using the head-related transfer function, so that a sound field space capable of obtaining a sound field space with higher realistic sensation can be created.

The surround system 100 of the embodiment also has the configuration that the frequency correcting circuit 204 calculates in advance the level ratio between the frequency characteristic in a position where the integral speaker system 130 is eccentric with respect to the listening position as a center and the frequency characteristic in a position where the integral speaker system 130 is installed with the listening position as a center, and adjusts the frequency characteristic of a surround signal on the basis of the calculated level ratio.

With the configuration, the surround system 100 of the embodiment corrects the frequency characteristic by using the level ratio between the head-related transfer function and the actual transfer function. Thus, a sound field space with higher realistic sensation can be created.

The surround system 100 of the embodiment has the configuration that the adder 205 multiplies the adjusted surround signal with a predetermined coefficient and adding the resultant surround signal to a main signal.

In the embodiment, the frequency correcting circuit 204 adjusts the frequency characteristic of one of the input surround signals which are switched by the switch control unit 203. Alternatively, without using the switching process of switching the inputs, the frequency correcting circuit 204 may be provided for each of the surround signals. In this case, in the frequency correcting circuit 204, an ideal transfer function and an actual transfer function are prepared for each surround signal, the level ratio between the transfer functions is calculated, and the frequency characteristic is adjusted with the level ratio. The adder 205 performs a process of adding a surround signal of a component on the side different from the right or left side with respect to the listening position on which the integral surround speaker 133 is installed to a main signal, and the process of outputting the resultant signal as a surround signal.

Although the case where the integral surround speaker 133 is installed on the right or left side has been described in the embodiment, obviously, similar effects can be displayed also in the case where the integral surround speaker 133 is set obliquely rearward. In this case, it is sufficient to prepare an ideal transfer function and a real transfer function, calculate the level ratio between the functions, and pre-set the ratio of addition to a main signal in the adding process and the ratio of an output of the surround signal. In this case as well, it is necessary to input the installation position of the integral surround speaker 133 by the operating unit 124.

Second Embodiment

Figure 6:
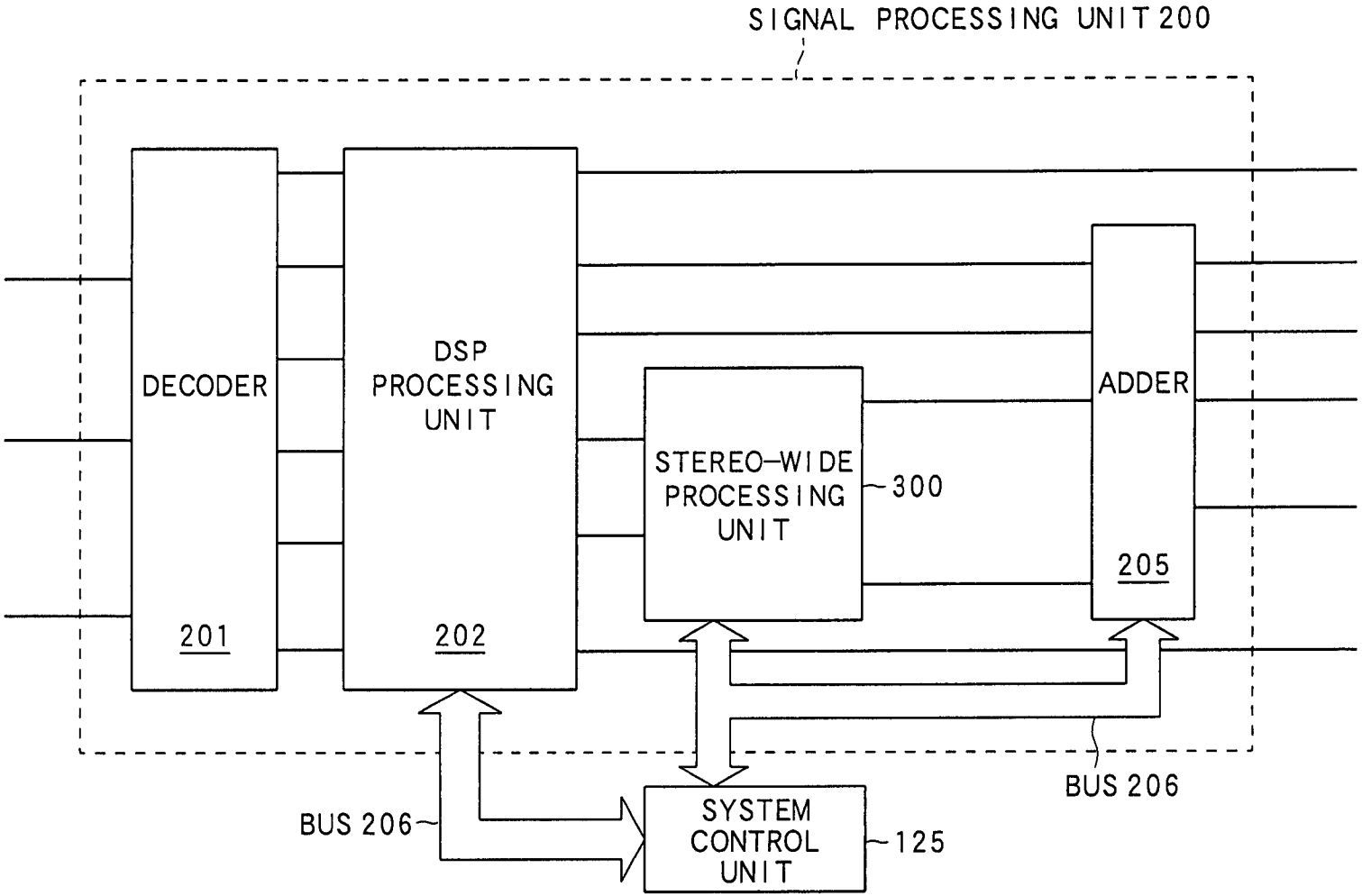
FIG. 6 is a block diagram showing the configuration in a signal processor of a second embodiment.

A second embodiment of a surround system according to the present invention will be described with reference to FIG. 6.

The surround system of the embodiment is characterized in that, in place of performing correction of the frequency characteristic of a selected audio signal, a stereo-wide process is performed on a selected audio signal. The configuration other than the characteristic point of the second embodiment is similar to that of the first embodiment. The same reference numerals are designated to the same components and their description will not be repeated.

First, the configuration of the signal processing unit of the second embodiment will be described with reference to FIG. 6. FIG. 6 is a block diagram showing the configuration of the signal processing unit of the second embodiment.

The signal processing unit 200 has: the decoder 201 for decoding input audio data to audio signals of respective channels; the DSP processing unit 202 for performing a predetermined digital signal process by operation of the operating unit 124 of the user; a stereo-wide processing unit 300 for performing a stereo-wide process on each of surround signals by using one of surround signals as a reference under control of the system control unit 125; and the adder 205 for adding the surround signal subjected to the stereo-wide process to a main signal.

For example, the stereo-wide processing unit 300 of the second embodiment corresponds to generating means, first computing means, and second computing means of the present invention. The adder 205 corresponds to adding means and output means of the present invention.

To the DSP processing unit 202, audio signals decoded on the channel unit basis are supplied. Under control of the system control unit 125, the DSP processing unit 202 performs predetermined digital signal process on the basis of an instruction input from the operating unit 124, and outputs the processed audio signals of the respective channels to the stereo-wide processing unit 300, the adder 205, and the D/A converter.

For example, in a manner similar to the first embodiment, when a sound field such as church, stadium, or a specific hall is set (hereinbelow, simply called sound field setting) by the operating unit 124, the DSP processing unit 202 performs digital signal processes such as delay process, frequency characteristic correcting process, and process of addition to an audio signal of another channel in an arbitrary audio signal so that input audio data is amplified in the sound field.

In the second embodiment, to perform processes which will be described later on a surround signal amplified from the integral surround speaker 133 and a main signal amplified from the FL speaker 132FL or the FR speaker 132FR, the DSP processing unit 202 outputs the surround signal to the stereo-wide processing unit 300 and outputs the main signal to the adder 205.

It is unnecessary to perform the signal process based on the setting position of the integral surround speaker 133 on a center signal amplified from the center speaker 131 and a woofer signal amplified from a sub woofer like in the first embodiment. Consequently, the DSP processing unit 202 directly outputs the center signal and the woofer signal to the D/A converter 122.

To the stereo-wide processing unit 300, a left surround signal to be amplified by a left speaker unit and a right surround signal to be amplified by a right speaker unit are input. Under control of the system control unit 125, the stereo-wide processing unit 300 performs the following processes and outputs each of the processed surround signals to the adder 205.

Stereo-Wide Process (1) selection of one of right and left surround signals which are input
(2) generation of a differential signal by subtracting the not-selected surround signal from the selected surround signal
(3) filter process performed on the generated differential signal with a low pass filter
(4) addition of the differential signal subjected to the filter process to the selected surround signal and output of the resultant signal
(5) subtraction of the differential signal subjected to the filter process from the not-selected surround signal and output of the resultant signal Concretely, in the case where the integral surround speaker 133 is installed on the right or left side of the listening position, that is, in the case where the integral speaker is installed in a position so that arrangement becomes asymmetrical with respect to the listening position as a center and an instruction of such installation is given to the stereo-wide processing unit 300 via the system control unit 125, the stereo-wide processing unit 300 selects a surround signal to be amplified on the side different from the side on which the integral surround speaker 133 is installed, subtracts the surround signal different from the selected surround signal from the selected surround signal to thereby generate a differential signal, performs a filter process on the differential signal, adds or subtracts the resultant signal to/from each of the surround signals, and outputs the resultant signal to the adder 205.

For example, in the case where the integral surround speaker 133 is installed on the right side of the listening position as shown in FIG. 2, the stereo-wide processing unit 300 uses the left surround signal as a selected surround signal and subtracts the right surround signal from the left surround signal, thereby generating a differential signal. The stereo-wide processing unit 300 adds a signal obtained by cutting high-frequency components of the generated differential signal to the left surround signal, and subtracts the signal obtained by cutting high-frequency components of the differential signal from the right surround signal.

In the case where the integral surround speaker 133 is installed rearward of the listening position, that is, in the case where the surround speaker 133 is set symmetrically with respect to the listening position and a message indicative of the symmetrical state is sent by the operating unit 124, the system control unit 125 does not output an instruction for executing the switch control to the stereo-wide process 300. The stereo-wide processing unit 300 therefore outputs the input surround signals directly to the adder 205.

To the adder 205, main signals, the surround signals output from the stereo-wide processing unit 300, and the surround signal subjected to stereo-wide process are supplied. Under control of the system control unit 125, the adder 205 performs the process of adding the main signal and the surround signal and the surround signal outputting process, and outputs the main signals and the surround signals to the respective D/A converters.

To be concrete, in a manner similar to the first embodiment, in the case where the integral surround speaker 133 is installed on the right or left side of the listening position, that is, in the case where the integral speaker is installed asymmetrically with respect to the listening position as a center and a message indicative of the asymmetrical state is sent to the adder 205 via the system control unit 125, the adder 205 adds a predetermined component in the surround signal selected at the time of the stereo-wide process to a main signal amplified from the main speaker on the same side with respect to the listening position, outputs the resultant to a D/A converter corresponding to the main signal, lowers the level of the surround signal subjected to the stereo-wide process, and outputs the resultant signal to the D/A converter corresponding to the surround signal.

For example, in the case where the integral surround speaker 133 is installed on the right side of the listening position as shown in FIG. 2, the adder 205 multiplies a left surround signal subjected to the stereo-wide process with a predetermined coefficient, adds the resultant signal to a left main signal, outputs the resultant left main signal and also outputs, as a left surround signal, a signal obtained by multiplying the left surround signal subjected to the stereo-wide process with the predetermined coefficient. In other words, the adder 205 adds part of the surround signal subjected to the stereo-wide process to a main signal and outputs, as the surround signal, the rest of the surround signal to the D/A converter.

In the second embodiment, in the case where the integral surround speaker 133 is installed on the right or left side of the listening position, the adder 205 adds a signal obtained by multiplying a surround signal subjected to the stereo-wide process with a coefficient (0.7) to a main signal and outputs, as a surround signal, a signal obtained by multiplying the surround signal subjected to the stereo-wide process with a coefficient (0.3).

In a manner similar to the first embodiment, to perform the digital signal process, at the time of adding a surround signal subjected to the stereo-wide process to a main signal, the adder 205 has to normalize each of main signals and surround signals. Specifically, a sum of a main signal and a surround signal does not exceed 1.0. By using the sum as a reference, the level of each of the main and surround signals is adjusted. At the time of output to the D/A converters, the adder 205 compensates the signal level by expanding the normalized level of each of the main and surround signals to the original level. In the embodiment, as for adjustment of the level of each signal, the compensation may be made not by the adder 205 but by each of the power amplifiers 123 via the system control unit 125.

On the other hand, in the case where the integral surround speaker 133 is installed on the rear side of the listening position and a message indicative of the installation is sent by the operating unit 124, the system control unit 125 does not output an instruction for executing the switch control to the adder 205. The adder 205 outputs each of the input surround and main signals directly to a corresponding D/A converter.

As described above, the surround system 100 of the second embodiment has: the signal processor 120 for allowing speakers corresponding to a plurality of input sound signals to amplify the sound signals, and providing a sound field space having the realism of a live performance to the listener; and the integral surround speaker 133 obtained by integrating the pair of right and left main speakers installed forward of the listening position and amplifying main signals as sound signals corresponding to the speakers, the left surround speaker for generating stereophonic sound by amplifying a surround signal as a sound signal of a left-side component with respect to the listening position as a reference, and a right surround speaker for generating stereophonic sound by amplifying a surround signal as a sound signal of a right-side component with respect to the listening position as a reference. The signal processor 120 has the stereo-wide processing unit 300 and the adder 205. In the case where the integral sound speaker 133 is installed in a position that the arrangement becomes asymmetrical with respect to the listening position as a center, the stereo-wide processing unit 300 performs a computing process of generating a differential signal by subtracting a surround signal on the side where the integral surround speaker is installed from a surround signal of a component of the side different from the side on which the integral surround speaker is disposed, and adding the generated differential signal to the surround signal of the component on the side different from the side on which the integral surround speaker 133 is installed, and performs a computing process of subtracting the generated differential signal from the surround signal of the component on the same side as that on which the integral surround speaker 133 is installed. The adder 205 adds at least part of the computed surround signal to a main signal of the component on the same side, outputs the resultant main signal to a corresponding main speaker, and outputs at least part of the surround signal subjected to the differential signal computing process to the corresponding surround speaker.

With the configuration, in the case where the integral surround speaker 133 is installed in a position that the arrangement becomes asymmetrical with respect to the listening position as a center, the surround system 100 of the second embodiment generates a differential signal on the basis of a surround signal of a component of a right or left side for a surround signal of a component on the side different from the side on which the integral surround speaker 133 is installed, and adds or subtracts the generated differential signal to/from each surround signal. The surround system 100 adds a component of at least part of the computed surround signal to a main signal of a component on the same side as that of the surround signal to which the differential signal is added, outputs the resultant main signal to a corresponding main speaker, and outputs at least a part of the surround signal to/from which the differential signal is added/subtracted to a corresponding surround speaker.

Therefore, when audio signals are amplified from the speakers, extension of amplified sound of the left surround component increases in the listening position. Consequently, even in the case where the integral surround speaker cannot be installed on the rear side of the listening position, an effect of natural sound can be obtained. As a result, in a manner similar to the first embodiment, even in the case where the integral sound speaker 133 is installed in a position different from a normal position, a sound field space with high realistic sensation can be provided for the user.

Third Embodiment

Figure 7:
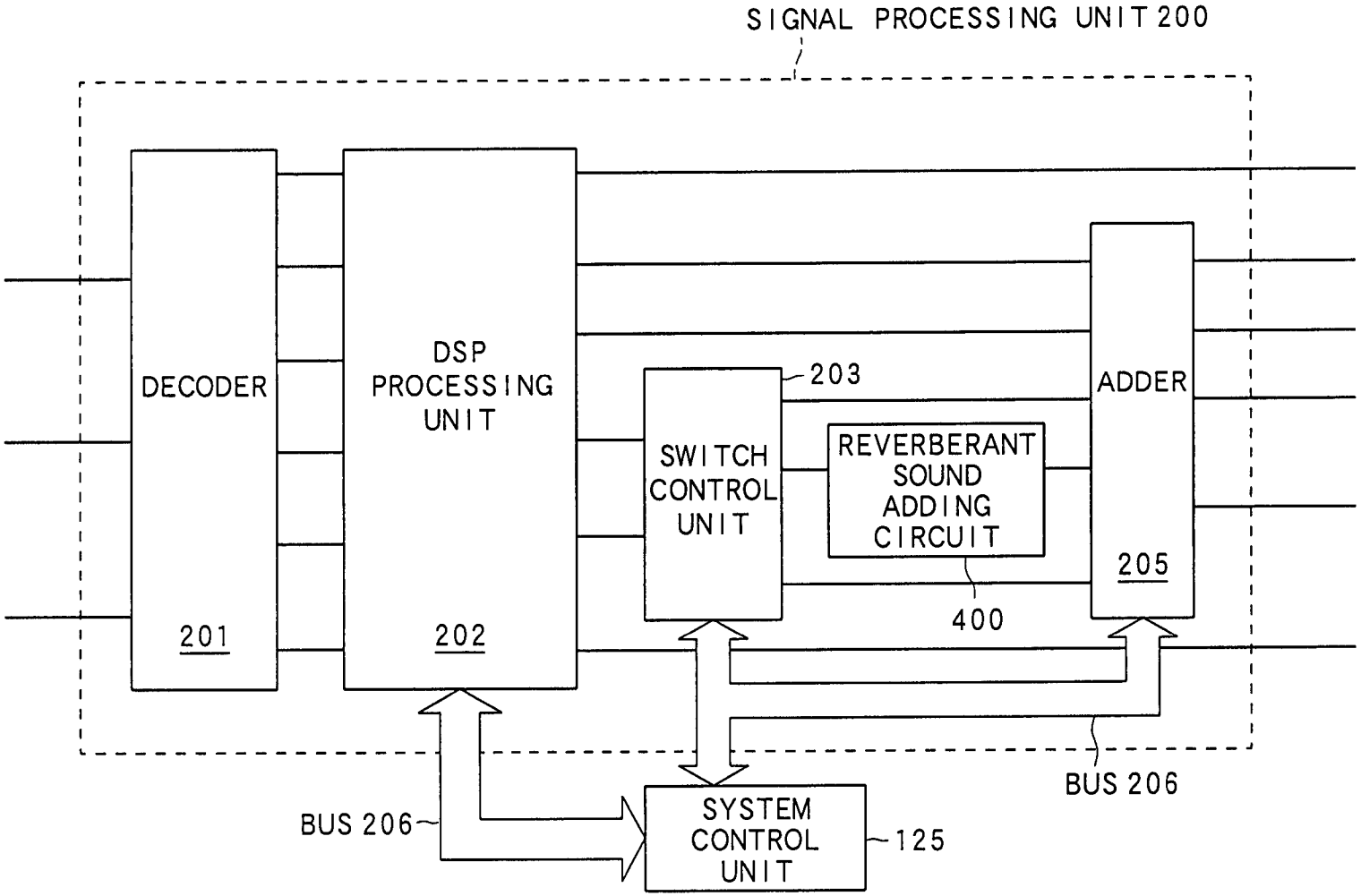
FIG. 7 is a block diagram showing the configuration in a signal processor of a third embodiment.

A third embodiment of a surround system according to the present invention will be described with reference to FIG. 7.

The surround system of the third embodiment is characterized in that, in place of performing correction of the frequency characteristic of a selected audio signal in the first embodiment, a reverberant component is added to a selected audio signal. The configuration other than the characteristic point of the third embodiment is similar to that of the first embodiment. The same reference numerals are designated to the same components and their description will not be repeated.

First, the configuration of the signal processing unit of the third embodiment will be described. FIG. 7 is a block diagram showing the configuration of the signal processing unit of the third embodiment.

The signal processing unit 200 has: the decoder 201 for decoding input audio data to audio signals of respective channels; the DSP processing unit 202 for performing a predetermined digital signal process by operation of the operating unit 124 of the user; the switch control unit 203 for selecting one of right and left surround signals amplified from the surround speaker; a reverberant sound adding circuit 400 for adding a reverberant component to the surround signal selected by the switch control unit 203; and the adder 205 for adding the surround signal to which the reverberant component is added to the DSP-processed main signal.

For example, the switch control unit 203 and the reverberant sound adding circuit 400 of the third embodiment correspond to generating means and computing means of the present invention. The adder 205 corresponds to adding means and output means of the present invention.

To the switch control unit 203, a left surround signal to be amplified by a left speaker unit and a right surround signal to be amplified by a right speaker unit are supplied. Under control of the system control unit 125, the switch control unit 203 outputs one of the input right and left surround signals to the reverberant sound adding circuit 400, and outputs the surround signal which is not output to the reverberant sound adding circuit 400 to the adder 205.

Concretely, in the case where the integral surround speaker 133 is installed on the right or left side of the listening position, that is, in the case where the integral speaker is installed in a position so that arrangement becomes asymmetrical with respect to the listening position as a center and an instruction of such installation is given to the switch control unit 203 via the system control unit 125, the switch control unit 203 outputs a surround signal to be amplified on the side different from the side on which the integral surround speaker 133 is installed to the reverberant sound adding circuit 400. In this case, the switch control unit 203 outputs a surround signal to be amplified on the side on which the integral surround speaker 133 is installed directly to the adder 205.

For example, in the case where the integral surround speaker 133 is installed on the right side of the listening position as shown in FIG. 2, the switch control unit 203 outputs a left surround signal to the reverberant sound adding circuit 400 and outputs a right surround signal to the adder 205.

In a manner similar to the first embodiment, in the case where the integral surround speaker 133 is installed rearward of the listening position, that is, in the case where the surround speaker 133 is set symmetrically with respect to the listening position and a message indicative of the symmetrical state is sent by the operating unit 124, the system control unit 125 does not output an instruction for executing the switch control to the switch control unit 203. The switch control unit 203 therefore outputs the input surround signals directly to the adder 205.

To the reverberant sound adding circuit 400, one of the surround signals is supplied. The reverberant sound adding circuit 400 internally performs predetermined delay process, and outputs the delayed surround signal to the adder 205.

To be concrete, the reverberant sound adding circuit 400 generates a signal obtained by attenuating the amplitude level in the input surround signal every delay time of a few (m·sec)×10−1 to a few (m·sec)×10, and adds the generated signal to the original signal, that is, the input surround signal.

For example, in the case where the integral surround speaker 133 is installed on the right side of the listening position as shown in FIG. 2, a left surround signal is supplied to the reverberant sound adding circuit 400. The reverberant sound adding circuit 400 generates a signal obtained by attenuating exponentially the left surround signal every predetermined delay time, adds the generated signal to the left surround signal, and outputs the resultant to the adder 205.

To the adder 205, in a manner similar to the first embodiment, main signals, the surround signals output from the switch control unit 203, and the surround signal to which reverberant sound is added are supplied. Under control of the system control unit 125, the adder 205 performs the process of adding the main signal and the surround signal and the surround signal outputting process, and outputs the main signals and the surround signals to the respective D/A converters.

To be concrete, in the case where the integral surround speaker 133 is installed on the right or left side of the listening position, that is, in the case where the integral speaker is installed asymmetrically with respect to the listening position as a center and the message indicative of the asymmetrical state is sent to the adder 205 via the system control unit 125, the adder 205 adds a predetermined component in the surround signal to which reverberant sound is added to a main signal amplified from the main speaker on the same side with respect to the listening position, outputs the resultant to the D/A converter corresponding to the main signal, lowers the level of the surround signal to which reverberant sound is added, and outputs the resultant signal to the D/A converter corresponding to the surround signal.

For example, in the case where the integral surround speaker 133 is installed on the right side of the listening position as shown in FIG. 2, reverberant sound is added to the left surround signal. Consequently, the adder 205 multiplies a left surround signal with a predetermined coefficient, adds the resultant signal to a left main signal, outputs the resultant left main signal and also outputs, as a left surround signal, a signal obtained by subtracting the left surround signal multiplied with the predetermined coefficient from the left surround signal. In other words, the adder 205 adds part of the surround signal subjected to the reverberant sound adding process to a main signal and outputs, as the surround signal, the rest of the surround signal to the D/A converter.

In the third embodiment, in a manner similar to the first embodiment, in the case where the integral surround speaker 133 is installed on the right or left side of the listening position, the adder 205 adds a signal obtained by multiplying a surround signal subjected to the reverberant sound adding process with a coefficient (0.7) to a main signal and outputs, as a surround signal, a signal obtained by multiplying the surround signal subjected to the reverberant sound adding process with a coefficient (0.3).

To perform the digital signal process, in a manner similar to the first embodiment, at the time of adding a surround signal to which reverberant sound is added to a main signal, the adder 205 of the third embodiment has to normalize each of main signals and surround signals. Specifically, a sum of a main signal and a surround signal does not exceed 1.0. By using the sum as a reference, the level of each of the main and surround signals is adjusted. At the time of outputting signals to the respective D/A converters, the adder 205 compensates the signal level by expanding the normalized level of each of the main and surround signals to the original level. In the third embodiment, as for adjustment of the level of each signal, the compensation may be made not necessarily by the adder 205 but may be made by each of the power amplifiers 123 via the system control unit 125.

On the other hand, in the case where the integral surround speaker 133 is installed on the rear side of the listening position and a message indicative of the installation is sent by the operating unit 124, the system control unit 125 does not output an instruction for executing the switch control to the adder 205. The adder 205 outputs each of the input surround and main signals directly to a corresponding D/A converter.

As described above, the surround system 100 of the third embodiment has: the signal processor 120 for allowing speakers to amplify a plurality of corresponding sound signals supplied on the basis of the sound signals, thereby providing a sound field space having the realism of a live performance to the listener; and the integral surround speaker 133 obtained by integrating the pair of right and left main speakers installed forward of the listening position and amplifying main signals as sound signals corresponding to the speakers, the left surround speaker for generating stereophonic sound by amplifying a surround signal as a sound signal of a left-side component with respect to the listening position as a reference, and a right surround speaker for generating stereophonic sound by amplifying a surround signal as a sound signal of a right-side component with respect to the listening position as a reference. The signal processor 120 has the reverberant sound adding circuit 400 and the adder 205. In the case where the integral sound speaker 133 is installed in a position that the arrangement becomes asymmetrical with respect to the listening position as a center, the reverberant sound adding circuit 400 performs computing process of generating a delay component having predetermined delay time for a surround signal of a component of the side different from the side on which the integral surround speaker 133 is installed, and adding the generated delay component to the surround signal used at the time of generating the delay component. The adder 205 adds a component of at least part of the computed surround signal to a main signal of the same side component as that of the computed surround signal, outputs the resultant main signal to a corresponding main speaker, and outputs at least part of the surround signal to which the reverberant sound is added to the corresponding surround speaker.

With the configuration, in the case where the integral surround speaker 133 is installed in a position that the arrangement becomes asymmetrical with respect to the listening position as a center, the surround system 100 of the third embodiment adds reverberant sound to a surround signal of a component of a side different from the side on which the integral surround speaker 133 is installed. The surround system 100 adds a component of at least part of the computed surround signal to a main signal of a component on the same side as that of the surround signal to which reverberant sound is added, outputs the resultant main signal to a corresponding main speaker, and outputs at least a part of the surround signal to which reverberant sound is added to the surround speaker.

Therefore, when audio signals are amplified from the speakers, extension of amplified sound of the left surround component in the listening position increases. Even in the case where the integral surround speaker cannot be installed on the rear side of the listening position, a natural sound effect can be obtained. As a result, in a manner similar to the first embodiment, even in the case where the integral sound speaker 133 is installed in a position different from a normal position, a sound field space with high realistic sensation can be provided for the user.

Fourth Embodiment

Figure 8:
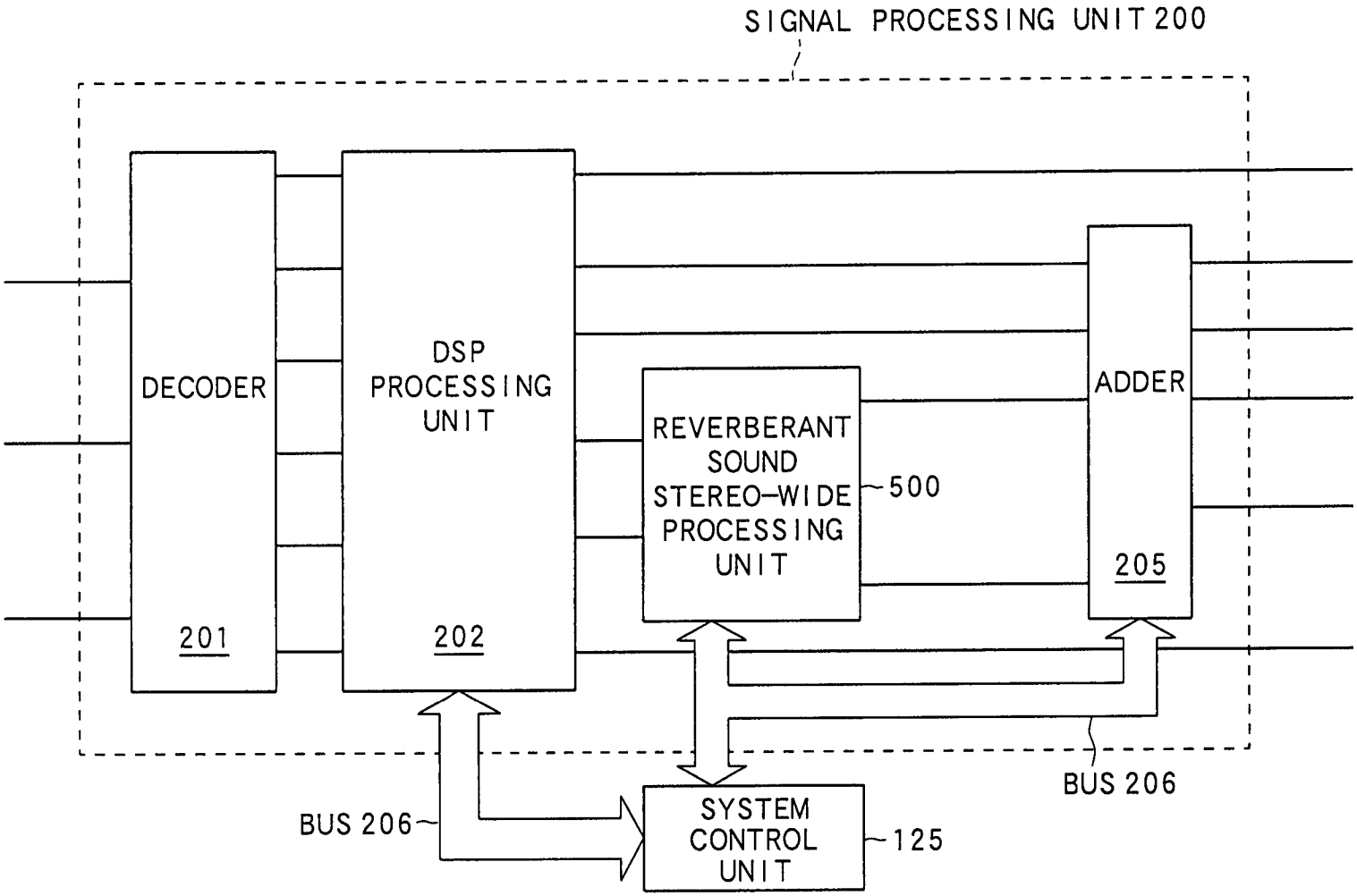
FIG. 8 is a block diagram showing the configuration in a signal processor of a fourth embodiment.

A fourth embodiment of a surround system according to the present invention will be described with reference to FIG. 8.

The surround system of the fourth embodiment is characterized in that, in place of performing correction of the frequency characteristic on a selected audio signal in the first embodiment, a reverberant sound addition stereo-wide process is performed on a selected audio signal. The configuration other than the characteristic point of the fourth embodiment is similar to that of the first embodiment. The same reference numerals are designated to the same components and their description will not be repeated.

First, the configuration of the signal processing unit of the fourth embodiment will be described with reference to FIG. 8. FIG. 8 is a block diagram showing the configuration of the signal processing unit of the fourth embodiment.

The signal processing unit 200 has: the decoder 201 for decoding input audio data to audio signals of respective channels; the DSP processing unit 202 for performing a predetermined digital signal process by operation of the operating unit 124 of the user; a reverberant sound addition stereo-wide processing unit 500 for performing a reverberant sound addition stereo-wide process on each of surround signals by using one of surround signals as a reference under control of the system control unit 125; and the adder 205 for adding the surround signal subjected to the reverberant sound addition stereo-wide process to a main signal.

For example, the reverberant sound addition stereo-wide processing unit 500 of the fourth embodiment corresponds to generating means, first computing means, and second computing means of the present invention. The adder 205 corresponds to adding means and output means of the present invention.

To the reverberant sound addition stereo-wide processing unit 500, a left surround signal to be amplified by a left speaker unit and a right surround signal to be amplified by a right speaker unit are input. Under control of the system control unit 125, the reverberant sound addition stereo-wide processing unit 500 performs the following processes and outputs each of the processed surround signals to the adder 205.

Reverberant Sound Addition Stereo-Wide Process (1) selection of one of right and left surround signals which are input
(2) generation of a differential signal by subtracting the not-selected surround signal from the selected surround signal
(3) filter process performed on the generated differential signal with a low pass filter
(4) generation a delay component having predetermined delay time with respect to the differential signal subjected to the filter process
(5) addition of the generated delay component to the selected surround signal and output of the resultant signal
(6) subtraction of the generated delay component from the not-selected surround signal and output of the resultant signal Concretely, in the case where the integral surround speaker 133 is installed on the right or left side of the listening position, that is, in the case where the integral speaker is installed in a position so that arrangement becomes asymmetrical with respect to the listening position as a center and an instruction of such installation is given to the reverberant sound addition stereo-wide processing unit 500 via the system control unit 125, the reverberant sound addition stereo-wide processing unit 500 selects a surround signal to be amplified on the side different from the side on which the integral surround speaker 133 is installed, subtracts the surround signal different from the selected surround signal from the selected surround signal to thereby generate a differential signal, and performs a filter process on the differential signal. Further, the reverberant sound addition stereo-wide processing unit 500 generates a signal obtained by attenuating the amplitude level in the differential signal subjected to the filter process every delay time of a few (m·sec)×10−1 to a few (m·sec)×10, adds/subtracts the delay component to/from the surround signal, and outputs the resultant to the adder 205.

For example, in the case where the integral surround speaker 133 is installed on the right side of the listening position as shown in FIG. 2, the reverberant sound addition stereo-wide processing unit 500 uses the left surround signal as a selected surround signal and subtracts a right surround signal from the left surround signal, thereby generating the differential signal. The reverberant sound addition stereo-wide processing unit 500 generates a signal obtained by exponentially attenuating a signal obtained by cutting a high frequency component of the generated differential signal every predetermined delay time. Further, the signal subjected to the delay process is added to the left surround signal and subtracted from the right surround signal from the alternately in a time sequence.

In a manner similar to the first embodiment, in the case where the integral surround speaker 133 is installed rearward of the listening position, that is, in the case where the surround speaker 133 is set symmetrically with respect to the listening position and a message indicative of the symmetrical state is sent by the operating unit 124, the system control unit 125 does not output an instruction for executing the switch control to the reverberant sound addition stereo-wide processing unit 500. The reverberant sound addition stereo-wide processing unit 500 therefore outputs the input surround signals directly to the adder 205.

To the adder 205, main signals and the surround signals which are output from the reverberant sound addition stereo-wide processing unit 500 and subjected to reverberant sound addition stereo-wide process are supplied. Under control of the system control unit 125, the adder 205 performs the process of adding the main signal and the surround signal and the surround signal outputting process, and outputs the main signals and the surround signals to the respective D/A converters.

To be concrete, in a manner similar to the first embodiment, in the case where the integral surround speaker 133 is installed on the right or left side of the listening position, that is, in the case where the integral speaker is installed a symmetrically with respect to the listening position as a center and a message indicative of the asymmetrical state is sent to the adder 205 via the system control unit 125, the adder 205 adds a predetermined component in the surround signal selected at the time of the reverberant sound addition stereo-wide process to a main signal amplified from the main speaker on the same side with respect to the listening position, outputs the resultant to a D/A converter corresponding to the main signal, lowers the level of the surround signal subjected to the reverberant sound addition stereo-wide process, and outputs the resultant signal to the D/A converter corresponding to the surround signal.

For example, in the case where the integral surround speaker 133 is installed on the right side of the listening position as shown in FIG. 2, the adder 205 multiplies a left surround signal subjected to the reverberant sound addition stereo-wide process with a predetermined coefficient, adds the resultant signal to a left main signal, outputs the resultant left main signal and also outputs, as a left surround signal, a signal obtained by multiplying the left surround signal subjected to the reverberant sound addition stereo-wide process with a predetermined coefficient. In other words, the adder 205 adds part of the surround signal subjected to the reverberant sound addition stereo-wide process to a main signal and outputs, as the surround signal, the rest of the surround signal to the D/A converter.

In the fourth embodiment, in a manner similar to the first embodiment, in the case where the integral surround speaker 133 is installed on the right or left side of the listening position, the adder 205 adds a signal obtained by multiplying a surround signal subjected to the reverberant sound addition stereo-wide process with a coefficient (0.7) to a main signal and outputs, as a surround signal, a signal obtained by multiplying the surround signal subjected to the reverberant sound addition stereo-wide process with a coefficient (0.3).

In a manner similar to the first embodiment, to perform the digital signal process, at the time of adding a surround signal subjected to the reverberant sound addition stereo-wide process to a main signal, the adder 205 has to normalize each of main signals and surround signals. Specifically, a sum of a main signal and a surround signal does not exceed 1.0. By using the sum as a reference, the level of each of the main and surround signals is adjusted. At the time of outputting a signal to the D/A converters, the adder 205 compensates the signal level by expanding the normalized level of each of the main and surround signals to the original level. In the fourth embodiment, as for adjustment of the level of each signal, the compensation may be made not by the adder 205 but by each of the power amplifiers 123 via the system control unit 125.

On the other hand, in the case where the integral surround speaker 133 is installed on the rear side of the listening position and a message indicative of the installation is sent by the operating unit 124, the system control unit 125 does not output an instruction for executing the switch control to the adder 205. The adder 205 outputs each of the input surround and main signals directly to a corresponding D/A converter.

As described above, the surround system 100 of the fourth embodiment has: the signal processor 120 for allowing speakers corresponding to a plurality of input sound signals to amplify the sound signals, thereby providing a sound field space having the realism of a live performance to the listener; and the integral surround speaker 133 obtained by integrating the pair of right and left main speakers installed forward of the listening position and amplifying main signals as sound signals corresponding to the speakers, the left surround speaker for generating stereophonic sound by amplifying a surround signal as a sound signal of a left-side component with respect to the listening position as a reference, and a right surround speaker for generating stereophonic sound by amplifying a surround signal as a sound signal of a right-side component with respect to the listening position as a reference. The signal processor 120 has the reverberant sound addition stereo-wide processing unit 500 and the adder 205. In the case where the integral sound speaker is installed in a position that the arrangement becomes asymmetrical with respect to the listening position as a center, the reverberant sound addition stereo-wide processing unit 500 performs a computing process of generating a differential signal by subtracting a surround signal on the side where the integral surround speaker is installed from a surround signal of a component of the side different from the side on which the integral surround speaker is disposed, generating a delay component for the generated differential signal, and adding the generated delay component to the surround signal of the component on the side different from the side on which the integral surround speaker 133 is installed, and performs a computing process of subtracting the generated delay component from the surround signal of the component on the same side as that on which the integral surround speaker 133 is installed. The adder 205 adds at least part of each of the computed surround signals to a main signal of the component on the same side, outputs the resultant main signal to a corresponding main speaker, and outputs at least part of the surround signal subjected to the delay component computing process to the corresponding surround speaker.

With the configuration, in the case where the integral surround speaker 133 is installed in a position that the arrangement becomes asymmetrical with respect to the listening position as a center, the surround system 100 of the fourth embodiment generates a differential signal on the basis of a surround signal of a component of a right or left side for a surround signal of a component on the side different from the side on which the integral surround speaker 133 is installed, generates a delay component for the generated differential signal, and adds or subtracts the generated delay component to/from each surround signal. The surround system 100 adds a component of at least part of the computed surround signal to a main signal of a component on the same side as that of the surround signal to which the delay component is added, outputs the resultant main signal to a corresponding main speaker, and outputs at least a part of the surround signal to/from which the delay component is added/subtracted to a corresponding surround speaker.

Therefore, when audio signals are amplified from the speakers, extension of amplified sound of the left surround component increases in the listening position. Consequently, even in the case where the integral surround speaker cannot be installed on the rear side of the listening position, an effect of natural sound can be obtained. As a result, in a manner similar to the first embodiment, even in the case where the integral sound speaker 133 is installed in a position different from a normal position, a sound field space with high realistic sensation can be provided for the user.

The entire disclosure of the Japanese Patent Application No. 2004-074540 filed on Mar. 16, 2004 and including the specification, the claims, the drawings and the abstract is incorporated herein by reference in its entirety.

The invention claimed is:

1. A stereophonic sound reproducing system comprising:

a stereophonic sound reproducing apparatus for providing a sound field space having the realism of a live performance to the listener by amplifying a plurality of input stereophonic sound signals by speakers corresponding to the stereophonic sound signals;

at least a pair of right and left main speakers installed forward of the listening position and amplifying main signals as stereophonic sound signals corresponding to the speakers; and an integral surround speaker obtained by integrally forming a left surround speaker for generating the stereophonic sound by amplifying a surround signal as a stereophonic sound signal of a left-side component with respect to the listening position as a reference, and a right surround speaker for generating the stereophonic sound by amplifying a surround signal as the stereophonic sound signal of a right-side component with respect to the listening position as a reference, wherein the stereophonic sound reproducing apparatus comprises:

a signal adjusting device, in the case where the integral surround speaker is installed in a position that makes arrangement asymmetrical with respect to the listening position as a center, which adjusts the frequency characteristic of a surround signal of a component of the side different from the side on which the integral surround speaker is asymmetrically installed on the basis of a transfer function for creating a sound image in a predetermined listening position;

an adding device which adds a component of at least part of the adjusted surround signal to a main signal of the component of the side different from the side on which the integral surround speaker is asymmetrically installed; and an output device which outputs the resultant main signal to the corresponding main speaker and outputs at least part of the surround signal whose frequency characteristic is adjusted to the corresponding surround speaker, and wherein the integral surround speaker is installed separately from a pair of the right and left main speakers.

2. The stereophonic sound reproducing system according to claim 1, wherein the signal adjusting device adjusts a frequency characteristic of each of surround signals of right-side and left-side components by using the transfer function every right-side and left-side component.

3. The stereophonic sound reproducing system according to claim 1, wherein the signal adjusting device adjusts a frequency characteristic of a surround signal by using a head-related transfer function (HRTF) as the transfer function for generating a sound image in a listing position in a predetermined space.

4. The stereophonic sound reproducing system according to claim 3, wherein the signal adjusting device preliminarily calculates a level ratio between a frequency characteristic in a position in which the integral speaker system is installed deviated from a listening position as a center and a frequency characteristic in a position in which the integral speaker system is installed using the listening position as a center by using a head-related transfer function (HRTF) as a transfer function for generating a sound image in the listening position in a predetermined space, and adjusts the frequency characteristic of a surround signal on the basis of the calculated level ratio.

5. The stereophonic sound reproducing system according to claim 1, wherein the adding device multiplies the adjusted surround signal with a predetermined coefficient and adding the resultant surround signal to the main signal.

6. The stereophonic sound reproducing system according to claim 1, wherein the integral speaker system is installed on a side of a listening position.

7. A stereophonic sound reproducing system comprising:

a stereophonic sound reproducing apparatus for providing a sound field space having the realism of a live performance to the listener by amplifying a plurality of input stereophonic sound signals by speakers corresponding to the stereophonic sound signals;

at least a pair of right and left main speakers installed forward of the listening position and amplifying main signals as stereophonic sound signals corresponding to the speakers; and an integral surround speaker obtained by integrally forming a left surround speaker for generating the stereophonic sound by amplifying a surround signal as a stereophonic sound signal of a left-side component with respect to the listening position as a reference, and a right surround speaker for generating the stereophonic sound by amplifying a surround signal as the stereophonic sound signal of a right-side component with respect to the listening position as a reference, wherein the stereophonic sound reproducing apparatus comprises:

a generating device, in the case where the integral surround speaker is installed in a position that makes arrangement asymmetrical with respect to the listening position as a center, which generates a differential signal by subtracting a surround signal of a component on the side on which the integral surround speaker is asymmetrically installed from a surround signal of a component of the side different from the side on which the integral surround speaker is asymmetrically installed;

a first computing device which performs a computing process of adding the generated differential signal to the surround signal of the component on the side different from the side on which the integral surround speaker is asymmetrically installed;

a second computing device which performs a computing process of subtracting the generated differential signal from the surround signal of the component on the same side as the side on which the integral surround speaker is asymmetrically installed;

an adding device with adds at least part of each of the surround signals subjected to the computing process to a main signal of a component on the corresponding side; and an output device which outputs the resultant main signal to the corresponding main speaker and outputs at least part of the surround signal subjected to the differential signal computing process to the corresponding surround speaker, and wherein the integral surround speaker is installed separately from a pair of the right and left main speakers.

8. A stereophonic sound reproducing system comprising:

a stereophonic sound reproducing apparatus for providing a sound field space having the realism of a live performance to the listener by amplifying a plurality of input stereophonic sound signals by speakers corresponding to the stereophonic sound signals;

at least a pair of right and left main speakers installed forward of the listening position and amplifying main signals as stereophonic sound signals corresponding to the speakers; and an integral surround speaker obtained by integrally forming a left surround speaker for generating the stereophonic sound by amplifying a surround signal as a stereophonic sound signal of a left-side component with respect to the listening position as a reference, and a right surround speaker for generating the stereophonic sound by amplifying a surround signal as the stereophonic sound signal of a right-side component with respect to the listening position as a reference, wherein the stereophonic sound reproducing apparatus comprises:

a generating device, in the case where the integral surround speaker is installed in a position that makes arrangement asymmetrical with respect to the listening position as a center, which generates a delay component having predetermined delay time with respect to a surround signal of a component on the side different from the side on which integral surround speaker is deviated and installed;

a computing device which performs computing process of adding the generated delay component to the surround signal used at the time of generating the delay component;

an adding device which adds a component of at least part of the surround signal subjected to the computing process to a main signal of a component on the same side as that of the surround signal subjected to the computing process; and an output device which outputs the resultant main signal to the corresponding main speaker and outputs at least part of the surround signal to which the delay component is added to the corresponding surround speaker, and wherein the integral surround speaker is installed separately from a pair of the right and left main speakers.

9. A stereophonic sound reproducing system comprising:

a stereophonic sound reproducing apparatus for providing a sound field space having the realism of a live performance to the listener by amplifying a plurality of input stereophonic sound signals by speakers corresponding to the stereophonic sound signals;

at least a pair of right and left main speakers installed forward of the listening position and amplifying main signals as stereophonic sound signals corresponding to the speakers; and an integral surround speaker obtained by integrally forming a left surround speaker for generating the stereophonic sound by amplifying a surround signal as a stereophonic sound signal of a left-side component with respect to the listening position as a reference, and a right surround speaker for generating the stereophonic sound by amplifying a surround signal as the stereophonic sound signal of a right-side component with respect to the listening position as a reference, wherein the stereophonic sound reproducing apparatus comprises:

a generating device, in the case where the integral surround speaker is installed in a position that makes arrangement asymmetrical with respect to the listening position as a center, which generates a differential signal by subtracting a surround signal of a component on the side on which integral surround speaker is deviated and installed from a surround signal of a component of the side different from the side on which the integral surround speaker is deviated and installed;

a generating device which generates a delay component having predetermined delay time with respect to the generated differential signal;

a first computing device which performs computing process of adding the generated delay component to the surround signal of the component on the side different from the side on which the integral surround speaker is deviated and installed;

a second computing device which performs computing process of subtracting the generated delay component from the surround signal of the component on the same side as the side on which the integral surround speaker is deviated and installed;

an adding device which adds at least part of each of the surround signals subjected to the computing process to a main signal of a component on the same side; and an output device which outputs the resultant main signal to the corresponding main speaker and outputs at least part of the surround signal subjected to the delay component computing process to the corresponding surround speaker, and wherein the integral surround speaker is installed separately from a pair of the right and left main speakers.

10. A stereophonic sound reproducing apparatus for providing a sound field space having the realism of a live performance to the listener by amplifying a plurality of input stereophonic sound signals by speakers corresponding to the stereophonic sound signals, in the case of amplifying sound by at least a pair of right and left main speakers installed forward of the listening position and amplifying main signals as stereophonic sound signals corresponding to the speakers, and an integral surround speaker obtained by integrally forming a left surround speaker for generating the stereophonic sound by amplifying a surround signal as a stereophonic sound signal of a left-side component with respect to the listening position as a reference, and a right surround speaker for generating the stereophonic sound by amplifying a surround signal as the stereophonic sound signal of a right-side component with respect to the listening position as a reference, and installing the integral surround speaker in a position that makes arrangement asymmetrical with respect to the listening position as a center, the apparatus comprising:

a signal adjusting device which adjusts the frequency characteristic of a surround signal of a component of the side different from the side on which the integral surround speaker is deviated and installed on the basis of a transfer function for creating a sound image in a predetermined listening position;

an adding device which adds a component of at least part of the adjusted surround signal to a main signal of the component on the same side as that of the adjusted surround signal; and an output device which outputs the resultant main signal to the corresponding main speaker and outputs at least part of the surround signal whose frequency characteristic is adjusted to the corresponding surround speaker, and wherein the integral surround speaker is installed separately from a pair of the right and left main speakers.

11. A stereophonic sound reproducing apparatus for providing a sound field space having the realism of a live performance to the listener by amplifying a plurality of input stereophonic sound signals by speakers corresponding to the stereophonic sound signals, in the case of amplifying sound by at least a pair of right and left main speakers installed forward of the listening position and amplifying main signals as stereophonic sound signals corresponding to the speakers, and an integral surround speaker obtained by integrally forming a left surround speaker for generating the stereophonic sound by amplifying a surround signal as a stereophonic sound signal of a left-side component with respect to the listening position as a reference, and a right surround speaker for generating the stereophonic sound by amplifying a surround signal as the stereophonic sound signal of a right-side component with respect to the listening position as a reference, and installing the integral surround speaker in a position that makes arrangement asymmetrical with respect to the listening position as a center, the apparatus comprising:

a generating device which generates a differential signal by subtracting a surround signal of a component on the side on which integral surround speaker is deviated and installed from a surround signal of a component of the side different from the side on which the integral surround speaker is deviated and installed;

a first computing device which performs computing process of adding the generated differential signal to the surround signal of the component on the side different from the side on which the integral surround speaker is deviated and installed;

a second computing device which performs computing process of subtracting the generated differential signal from the surround signal of the component on the same side as the side on which the integral surround speaker is deviated and installed;

an adding device which adds at least part of each of the surround signals subjected to the computing process to a main signal of a component on the same side; and an output device which outputs the resultant main signal to the corresponding main speaker and outputs at least part of the surround signal subjected to the differential signal computing process to the corresponding surround speaker, and wherein the integral surround speaker is installed separately from a pair of the right and left main speakers.

12. A stereophonic sound reproducing apparatus for providing a sound field space having the realism of a live performance to the listener by amplifying a plurality of input stereophonic sound signals by speakers corresponding to the stereophonic sound signals, in the case of amplifying sound by at least a pair of right and left main speakers installed forward of the listening position and amplifying main signals as stereophonic sound signals corresponding to the speakers, and an integral surround speaker obtained by integrally forming a left surround speaker for generating the stereophonic sound by amplifying a surround signal as a stereophonic sound signal of a left-side component with respect to the listening position as a reference, and a right surround speaker for generating the stereophonic sound by amplifying a surround signal as the stereophonic sound signal of a right-side component with respect to the listening position as a reference, and installing the integral surround speaker in a position that makes arrangement asymmetrical with respect to the listening position as a center, the apparatus comprising:

a generating device which generates a delay component having predetermined delay time with respect to a surround signal of a component on the side different from the side on which integral surround speaker is deviated and installed;

a computing device which performs computing process of adding the generated delay component to the surround signal used at the time of generating the delay component;

an adding device which adds a component of at least part of the surround signal subjected to the computing process to a main signal of a component on the same side as that of the surround signal subjected to the computing process; and an output device which outputs the resultant main signal to the corresponding main speaker and outputs at least part of the surround signal to which the delay component is added to the corresponding surround speaker, and wherein the integral surround speaker is installed separately from a pair of the right and left main speakers.

13. A stereophonic sound reproducing apparatus for providing a sound field space having the realism of a live performance to the listener by amplifying a plurality of input stereophonic sound signals by speakers corresponding to the stereophonic sound signals, in the case of amplifying sound by at least a pair of right and left main speakers installed forward of the listening position and amplifying main signals as stereophonic sound signals corresponding to the speakers, and an integral surround speaker obtained by integrally forming a left surround speaker for generating the stereophonic sound by amplifying a surround signal as a stereophonic sound signal of a left-side component with respect to the listening position as a reference, and a right surround speaker for generating the stereophonic sound by amplifying a surround signal as the stereophonic sound signal of a right-side component with respect to the listening position as a reference, and installing the integral surround speaker in a position that makes arrangement asymmetrical with respect to the listening position as a center, the apparatus comprising:

a generating device which generates a differential signal by subtracting a surround signal of a component on the side on which integral surround speaker is deviated and installed from a surround signal of a component of the side different from the side on which the integral surround speaker is deviated and installed;

a generating device which generates a delay component having predetermined delay time with respect to the generated differential signal;

a first computing device which performs computing process of adding the generated delay component to the surround signal of the component on the side different from the side on which the integral surround speaker is deviated and installed;

a second computing device which performs computing process of subtracting the generated delay component from the surround signal of the component on the same side as the side on which the integral surround speaker is deviated and installed;

an adding device which adds at least part of each of the surround signals subjected to the computing process to a main signal of a component on the same side; and an output device which outputs the resultant main signal to the corresponding main speaker and outputs at least part of the surround signal subjected to the delay component computing process to the corresponding surround speaker, and wherein the integral surround speaker is installed separately from a pair of the right and left main speakers.

* * * * *